US010141145B2

(12) United States Patent
Tanaka et al.

(10) Patent No.: US 10,141,145 B2
(45) Date of Patent: Nov. 27, 2018

(54) RELAY APPARATUS HAVING PLURALITY OF RELAYS AND RELAY SYSTEM INCORPORATING THE RELAY APPARATUS

(71) Applicants: NIPPON SOKEN, INC., Nishio, Aichi-pref. (JP); DENSO CORPORATION, Kariya, Aichi-pref. (JP); ANDEN CO., LTD., Anjo, Aichi-pref. (JP)

(72) Inventors: Ken Tanaka, Nishio (JP); Shota Iguchi, Kariya (JP)

(73) Assignees: NIPPON SOKEN, INC., Nishio (JP); DENSO CORPORATION, Kariya (JP); ANDEN CO., LTD., Anjo (JP)

( * ) Notice: Subject to any disclaimer, the term of this patent is extended or adjusted under 35 U.S.C. 154(b) by 284 days.

(21) Appl. No.: 15/087,318

(22) Filed: Mar. 31, 2016

(65) Prior Publication Data

US 2016/0293368 A1 Oct. 6, 2016

(30) Foreign Application Priority Data

Mar. 31, 2015 (JP) ..... 2015-072042

(51) Int. Cl.
*H01H 50/40* (2006.01)
*H01H 47/32* (2006.01)
(Continued)

(52) U.S. Cl.
CPC ..... *H01H 50/40* (2013.01); *H01H 47/32* (2013.01); *H01H 50/546* (2013.01); *H01H 51/20* (2013.01)

(58) Field of Classification Search
CPC ..... H01H 50/40; H01H 50/546; H01H 47/32; H01H 51/20
See application file for complete search history.

(56) References Cited

U.S. PATENT DOCUMENTS 2,528,777 A * 11/1950 Persons ..... H01H 50/323 335/259
7,671,711 B2 * 3/2010 Suzuki ..... H01H 71/68 200/330

(Continued)

FOREIGN PATENT DOCUMENTS

JP S56-030224 A 3/1981
JP 2002-184284 A 6/2002

(Continued)

*Primary Examiner* — Scott Bauer
(74) *Attorney, Agent, or Firm* — Oliff PLC

(57) ABSTRACT

A relay apparatus incorporates at least first and second relays having respective first and second electromagnetic coils, with a single yoke partially surrounding each of the coils. When current is passed through only the first electromagnetic coil, to activate the first relay, resultant magnetic flux acting on the armature of the second relay is attenuated by passing a current through the second electromagnetic coil to produce opposing-direction magnetic flux. When current is passed in the opposite direction through the second coil, to activate the second relay, the magnetic fluxes produced by the first and second electromagnetic coils become mutually reinforced, thereby reducing the power consumption required to activate both of the relays and to maintain that activated state.

19 Claims, 13 Drawing Sheets

(51) Int. Cl.
*H01H 50/54* (2006.01)
*H01H 51/20* (2006.01)

(56) References Cited

U.S. PATENT DOCUMENTS

| | | | | |
|---|---|---|---|---|
| 9,514,872 | B2 * | 12/2016 | Rallabandi ..... | H01H 33/6662 |
| 2011/0075315 | A1 | 3/2011 | Dickerhoof et al. | |
| 2013/0207750 | A1 | 8/2013 | Daitoku et al. | |
| 2013/0222089 | A1 | 8/2013 | Daitoku et al. | |
| 2014/0225691 | A1 | 8/2014 | Tanaka et al. | |
| 2016/0293365 | A1 | 10/2016 | Tanaka et al. | |

FOREIGN PATENT DOCUMENTS

| | | | |
|---|---|---|---|
| JP | 2010-212035 | A | 9/2010 |
| JP | 2010-287455 | A | 12/2010 |
| JP | 2012-152071 | A | 8/2012 |
| JP | 2013-164900 | A | 8/2013 |
| JP | 2013-179243 | A | 9/2013 |
| JP | 2013-211514 | A | 10/2013 |
| JP | 2014-170738 | A | 9/2014 |

* cited by examiner

RELAY APPARATUS HAVING PLURALITY OF RELAYS AND RELAY SYSTEM INCORPORATING THE RELAY APPARATUS

CROSS-REFERENCE TO RELATED APPLICATIONS

This application is based on and incorporates herein by reference Japanese Patent First Application No. 2015-72042 filed on Mar. 31, 2015.

BACKGROUND OF THE INVENTION

Field of Application

The present invention relates to a relay apparatus having a plurality of relays having respective contact switches, and to a relay system which incorporates such a relay apparatus.

Description of Related Art

Types of solenoid-operated relay apparatus have been proposed, having a plurality of solenoids with respective plungers for actuating respective contact switches, designed to be manufactured at lower cost than has hitherto been possible. The term "contact switch" is used herein to signify an on/off switch having fixed and movable contacts, which is actuated (switched between a non-conducting and a conducting state) by displacing the movable contact, as opposed to a semiconductor switching element such as a transistor. Examples of a solenoid-operated relay apparatus are described in Japanese patent publication No. 2013-211514, referred to in the following as reference 1. The relay apparatus of a first embodiment of reference 1 consists of a pair of solenoid-operated relays having respective contact switches, with only the solenoid of a first one of the relays having a corresponding electromagnetic coil, and with a magnetic flux generated by that electromagnetic coil being used to also activate the solenoid of the second relay. With the relay apparatus of reference 1, activation of the relays is performed in a specific sequence. Firstly, both of the relays are inactivated. The first relay is then activated by passing a sufficient level of current through the corresponding electromagnetic coil, pulling the corresponding plunger into a central aperture of the coil by magnetic attraction. Part of the magnetic flux produced by the electromagnetic coil of the first relay acts on the plunger of the second relay, but is insufficient to activate the second relay until the plunger of the first relay has become fully drawn into the central aperture of the electromagnetic coil. Both the relays are then left activated (both of the corresponding contact switches held in a conducting state).

Normally, leaving a pair of solenoids in an activated condition for a long period of time will result in a high level of electric power consumption. The apparatus of reference 1 is claimed to enable a reduction of 50% of the electric power required for maintaining both of the relays activated, by comparison with a conventional type of relay apparatus in which both of the relays are provided with respective electromagnetic coils.

However with the invention of reference 1, it is not possible to decrease the power consumption by more than 50% relative to a conventional type of relay apparatus. Furthermore all of the magnetic flux is concentrated in a magnet circuit passing through the single electromagnetic coil, so that it is necessary for the cross-sectional area of the central aperture of that electromagnetic coil (i.e., an aperture into which the corresponding plunger is drawn) to be large. Hence, the external dimensions of the electromagnetic coil must correspondingly be large, thereby increasing the overall size of the relay apparatus. In addition, the manufacturing cost will be high, due to the large amount of copper which must be used to form the single electromagnetic coil.

Furthermore, there will be differences between the forces applied by the respective plungers of the two solenoids when activated), on the corresponding contact switches, so that the characteristics of the two relays will be unbalanced.

SUMMARY OF THE INVENTION

Hence it is desired to overcome the above problems, by providing a relay apparatus whereby the power consumption and external dimensions of the apparatus can be reduced by comparison with the prior art, and to provide a relay system incorporating the relay apparatus.

The invention provides a relay apparatus which includes at least a first and a second relay having respective first and second electromagnetic coils (referred to in the following simply as coils), respective first and second movable magnetic members (where movable magnetic member here signifies an armature in the case of an electromagnet type of relay, or a plunger in the case of a solenoid type of relay) and respective contact switches. Each contact switch is actuated to an on (conducting) state or to an off (non-conducting) state when a current is passed through the corresponding coil, producing magnetic excitation which causes displacement of the corresponding movable magnetic member. The invention is specifically advantageous when applied to a relay apparatus having a plurality of relays which are controlled to change sequentially from the inactivated to the activated state, thereby successively operating respective contact switches of the relays.

The relay apparatus of the invention is characterized in that a single yoke is common to each of the relays, and is configured to partially surround each of respective coils of the relays. In the case of a relay apparatus having two relays, with a first relay being activated prior to a second relay, the yoke is formed such that:

(a) when magnetic excitation of the first coil (of the first relay) is produced, a first magnetic flux flows via a first magnetic circuit around the first coil, extending through the first movable magnetic member and the yoke;

(b) when magnetic excitation of the second coil is produced, a second magnetic flux flows via a second magnetic circuit around the second coil, extending through the second movable magnetic member and the yoke; and (c) when respective currents are passed concurrently through the first and second coils, for activating the second relay, a third magnetic flux flows via a third magnetic circuit, extending successively through the first movable magnetic member, the yoke, the second movable member, and back through the yoke. The third magnetic flux consists of respective parts of the magnetic flux produced by the first and second coils. By ensuring identical directions of magnetic flux flow from the first and second coils through the third magnetic circuit, these magnetic flux flows become mutually reinforced, thereby reducing the level of electric power required to activate the second relay, and also reducing the level of electric power required to maintain the first and second relays in the activated state, by comparison with the prior art.

To ensure that the second relay can only become activated after the first relay (i.e., prevent accidental activation of the second relay when only the first relay is to be activated), a part of the yoke is preferably formed with a magnetic flux restriction section, having a reduced cross-sectional area, formed and positioned such as to restrict the flow of magnetic flux produced from the first coil around the second coil.

Alternatively or in addition to employing a magnetic flux restriction section, while only the first relay is to be activated, a current is passed through the second coil in a direction predetermined for producing a flow of magnetic flux in a direction opposing (and thereby suppressing) the flow of magnetic flux produced from the first coil around the second coil, to reliably ensure that the second relay can only become activated after the first relay.

Similar advantages can be obtained for a relay apparatus having three or more relays.

The invention further provides a relay system incorporating a relay apparatus as described above, in which a relay control circuit controls the supplying of currents to the coils of the relays by selectively connecting/disconnecting the coils to/from an electric power source. The control is performed to operate the contact switches of the relays in a required sequence of conditions, e.g., ((1) a first connection condition, in which only the first coil is connected in parallel with the control circuit power source (only the contact switch of the first relay is actuated), (2) a second connection condition, in which both of the first and second coils are connected in parallel with the power source (respective contact switches of both relays are actuated), and (3) a third connection condition, in which the first and second coils are connected in series across the power source (respective contact switches of both relays remain actuated).

In the third connection condition, due to the reduced level of current which flows through the series-connected coils, the power consumption can be reduced by 75%, by comparison with the parallel-connected condition. Such a reduction of power consumption is significant, when the relay apparatus must be left for long periods with both of the contact switches held activated.

The relay system may be applied for example to control the supplying of power to an electrical load via a pair of supply leads, from an electric power source, with the supply leads respectively connected in series with the first and second contact switches of the relays.

DESCRIPTION OF PREFERRED EMBODIMENTS

Figure 1:
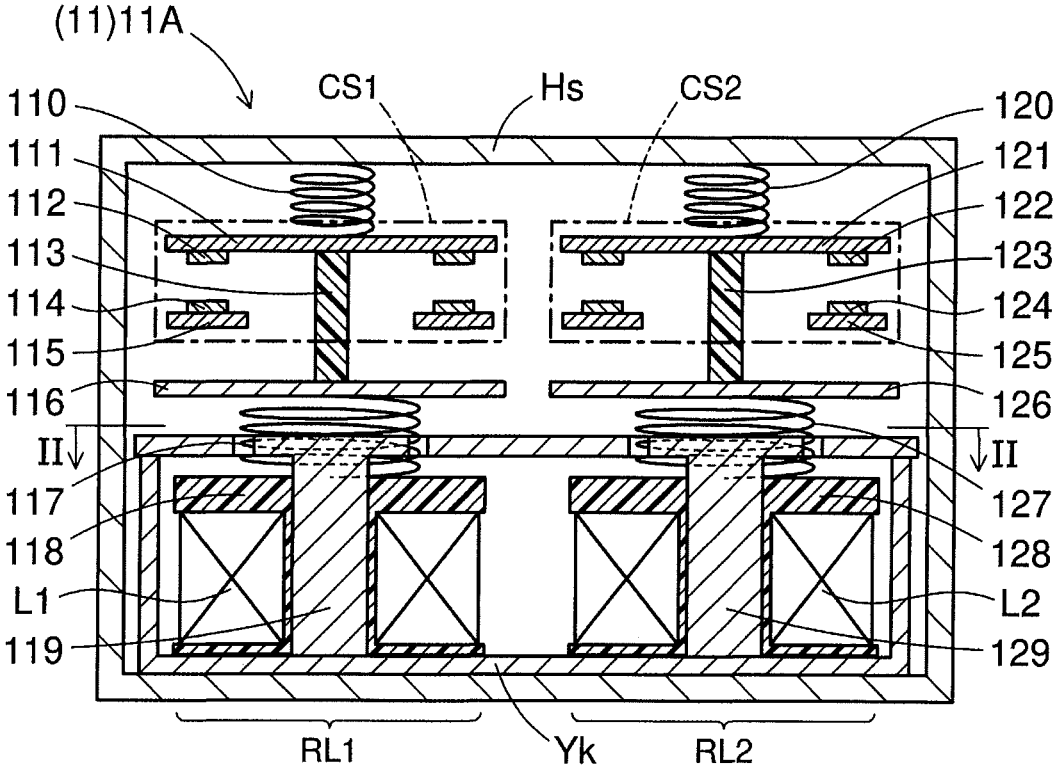
FIG. 1 is a conceptual cross-sectional view of a first embodiment of a relay apparatus.

In the following, "switch contacts" are referred to simply as "contacts". The directions "up", "down", "right", "left" are to be understood to refer to directions as viewed in the drawings. In the drawing designations, a distinction is made between upper-case and lower-case letters. For example a control section 12A is to be distinguished from a controller 12*a*. The term "on" or "activated" applied to a switching device signifies a conducting condition, while "off" or "inactivated" signifies a non-conducting condition. A relay is "activated" when the armature of the relay is fully drawn into contact with the yoke by magnetic attraction, in the case of an electromagnet type of relay. In the case of a solenoid type of relay, the relay is "activated" when the plunger of the relay becomes fully retracted into a central aperture of the relay coil by magnetic attraction.

First Embodiment

A first embodiment of a relay apparatus will be described referring to FIGS. 1~4. As shown in FIG. 1 the relay apparatus 11*a* includes a pair of electromagnet types of relays RL1 and RL2, a yoke Yk and a housing Hs. The relay RL1 is formed of a coil spring 110, a movable member 111, an insulator 113, a fixed member 115, an armature 116, a coil spring 117, a coil bobbin 118, a No. 1 core 119, and a No. 1 electromagnetic coil (referred to in the following simply as "coil") L1.

The coil springs 110 and 117 support the movable member 111 for reciprocating motion. It would be equally possible to use other types of elastic members for the functions of the coil springs 110 and 117, such as leaf springs, members formed of rubber or gel, etc. The movable member 111 is partially or entirely formed of a magnetic material which is also electrically conductive, and the armature 116 is partially or entirely formed of a magnetic material.

FIG. 1 shows a first condition of the relay apparatus 11A, in which no current flows through the No. 1 coil L1 or a No. 2 coil L2 (of the relay RL2), so that neither of the relays RL1, RL2 is activated. A first contact switch CS1 (of the relay RL1, indicated by a broken-line outline) is formed by the movable contact 112 mounted on the movable member 111 and the fixed contact 114 mounted on the fixed member 115. A second contact switch CS2 (of the relay RL2) is similarly formed of a movable contact 122 and movable member 121, and a fixed contact 124 and fixed member 125.

The movable member 111 and the armature 116 are fixedly attached to one another by the insulator 113. The armature 116 becomes attracted onto the No. 1 core 119 when a current flows through the No. 1 coil L1, producing magnetic excitation, thereby actuating the contact switch CS1 to a conducting state by bringing the movable contact 112 and fixed contact 114 together. When no current flows through the No. 1 coil L1, the armature 116 is held pulled apart from the No. 1 core 119 by the actions of the springs 110 and 117.

The No. 1 coil L1 is wound on a coil bobbin 118 formed of an electrically insulating material. A central cavity in the No. 1 coil L1 contains the No. 1 core 119, which is formed of a magnetic material. The No. 1 coil L1, the coil bobbin 118 and the No. 1 core 119 are fixedly retained by the yoke Yk.

Figure 2:
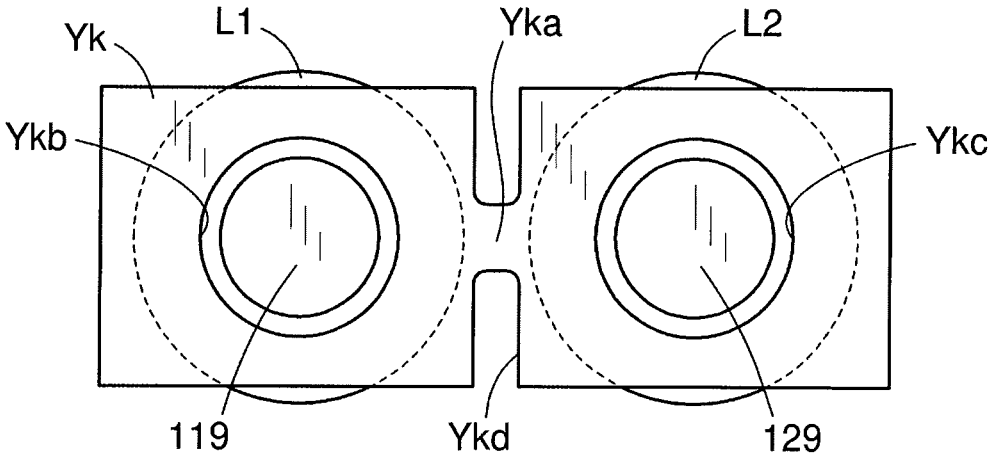
FIG. 2 is a plan view showing a yoke and electromagnetic coils of the relay apparatus of FIG. 1, as viewed along a direction II-II indicated in FIG. 1, illustrating a first example of a magnetic flux restriction section formed in the yoke.

The plan view of FIG. 2 shows a portion of the yoke Yk (referred to in the following as the upper bridging portion) which bridges the upper ends of the first and second coils L1, L2. This upper bridging portion of the yoke Yk contains two through-holes Ykb and Ykc, and two cut-out sections Ykd. The cut-out sections Ykd form a magnetic flux restriction section Yka of the yoke Yk, for restricting a flow of magnetic flux through the yoke Yk. The through-hole Ykb is located such as to prevent contact between the No. 1 core 119 and the yoke Yk, while similarly the through-hole Ykc is located such as to prevent contact between the No. 2 core 129 and the yoke Yk. The relay RL2 is formed of a coil spring 120, the movable member 121, the movable contact 122, an insulator 123, the fixed contact 124, the fixed member 125, an armature 126, a coil spring 127, a coil bobbin 128, a No. 2 core 129 and the No. 2 coil L2.

The relay RL2 has the same configuration as the relay RL1, with component parts having the same positional relationships as those of the relay RL1. The No. 1 coil L1 is configured to produce a smaller value of magnetizing force (MF1) than a magnetizing force (MF2) produced by the No. 2 coil L2, when the coils L1 and L2 are connected in parallel to the same power supply voltage, e.g., with the No. 1 coil L1 being formed with a higher resistance value than the No. 2 coil L2, to thereby pass a lower value of current than the coil L2.

The respective directions of winding of the No. 1 coil L1 on the coil bobbin 118 and No. 2 coil L2 on the coil bobbin 128 can be arbitrarily determined, so long as the respective directions of flow of current through the coils establish specific relationships between directions of flow of magnetic flux, described hereinafter.

Figure 3:
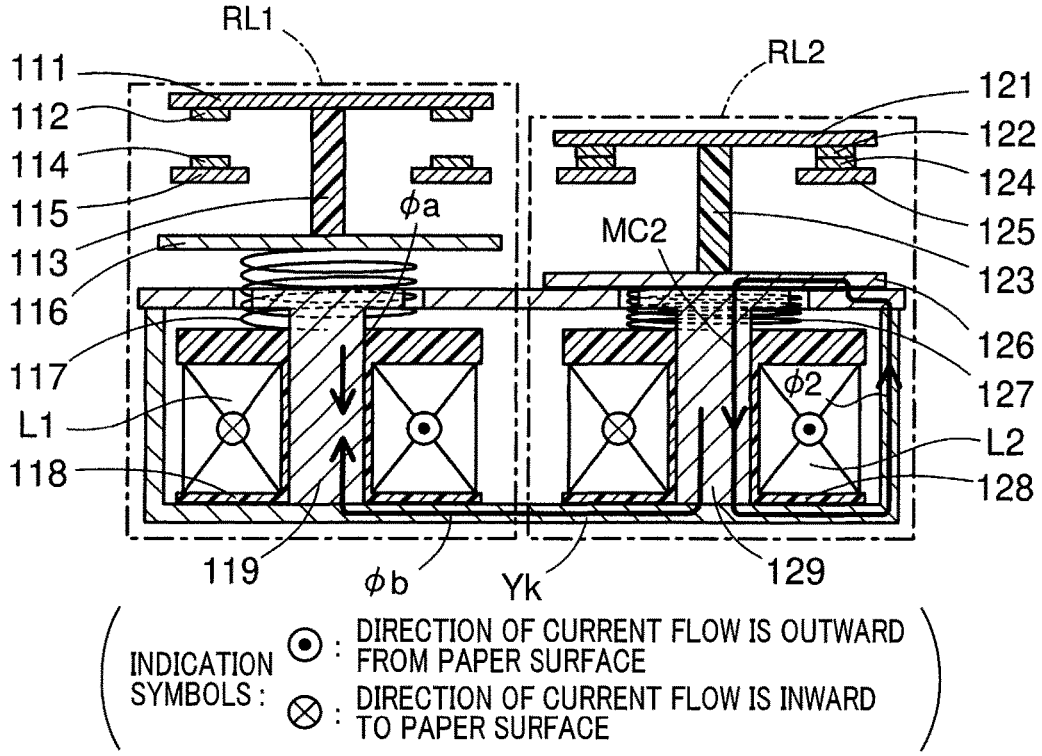
FIG. 3 is a diagram corresponding to FIG. 1, showing one of two relays of the relay apparatus set in an activated condition, with a corresponding contact switch set in an on state.

With a second condition of the relay apparatus 11A shown in FIG. 3, the relay RL2 is activated while the relay RL1 remains in the off state. It will first be assumed that, to reach this condition, a current is passed through only the No. 2 coil L2 of relay RL2, to produce magnetic excitation. The flow of current is in the direction shown by the indication symbols, producing a flow of magnetic flux designated as the No. 2 magnetic flux $\phi$2, via a path:

No. 2 core 129→yoke Yk→armature 126→No. 2 core 129

The flow path of the No. 2 magnetic flux $\phi$2 is designated as the No. 2 magnetic circuit MC 2. (If the direction of current flow through the No. 2 coil L2 were to be reversed, the flow direction of the No. 2 magnetic flux $\phi$2 would be correspondingly reversed).

Part of the magnetic flux produced in the No. 2 core 129, designated as $\phi$b, flows through a lower bridging portion of the yoke Yk (i.e., which bridges the lower ends of the No. 1 coil L1 and the No. 2 coil L2) via a third magnetic circuit MC 3 which includes the magnetic flux restriction section Yka of the yoke Yk. The main part ($\phi$2) of the magnetic flux generated in the No. 2 core 129 flows around the No. 2 coil L2, and a resultant magnetizing force acting on the armature 126 causes displacement of the armature 126, and hence actuation of the contact switch CS2. The flow of remaining flux ($\phi$b) of the No. 2 core 129 is restricted, since it must flow along a path having high magnetic resistance which is increased by the magnetic flux restriction section Yka. Hence a magnetizing force acting on the armature 116 at this time (resulting from the flow of magnetic flux $\phi$b) is made insufficient to displace the armature 116, so that the relay RL1 remains inactivated (contact switch CS1 remains off).

Thus in the second condition shown in FIG. 3, only the contact switch SW2 of the relay RL2 is actuated.

However in addition to forming the magnetic flux restriction section Yka (or as an alternative), the condition of the relay apparatus shown in FIG. 3 is preferably established by also passing a current through the No. 1 coil L1. In this case the respective directions of flow of currents through the coils L1 and L2 (the directions shown by the indication symbols in FIG. 3) cause the direction of a resultant flow of magnetic flux $\phi$a through the core 119 of the No. 1 coil L1 to become opposite to the direction of a flow of flux $\phi$b. The flux $\phi$b is part of the magnetic flux produced by the No. 1 coil L2, and would pass via the yoke Yk, possibly causing attraction of the armature 113 of relay RL1, unless suppressed. However the magnetic flux $\phi$a produced by the No. 1 coil L1 at this time effectively suppresses the magnetic flux $\phi$b. The relay RL1 can thereby be reliably held unactivated at the time of activating the relay RL2.

Figure 4:
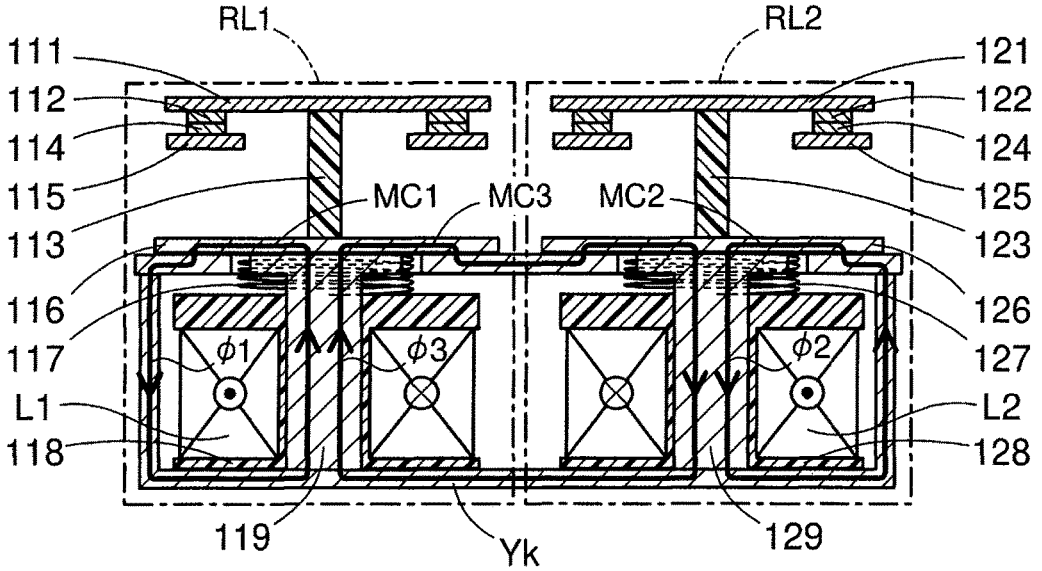
FIG. 4 is a diagram corresponding to FIG. 1, showing both of two relays of the relay apparatus set in the activated condition, with respective contact switches of the relays set in the on state.

FIG. 4 shows a third condition of the relay apparatus 11A, in which both of the relays RL1 and RL2 are activated (both of the switches SW1 and SW2 actuated to the conducting state). In this condition, the current passed through the No. 2 coil L2 remains unchanged from the second condition described above. However in the third condition, a current is passed through the No. 1 core 119 in the opposite direction to that shown in FIG. 3. The resultant magnetic excitation of the core 119 produces a flow of No. 1 magnetic flux $\phi$1 via a path surrounding the No. 1 coil L1:

No. 1 core 119→yoke Yk→armature 116→No. 1 core 119

This flow path is designated as the No. 1 magnetic circuit MC 1.

In addition, a part of the magnetic flux produced by the coil L1 and a part of the magnetic flux produced by the coil L2 flow in the same direction through the third magnetic circuit MC3, and hence become mutually reinforced. That is, a flow of No. 3 magnetic flux $\phi$3 occurs around a path:

No. 2 core 129→(lower bridging portion of yoke Yk)→No. 1 core 119→armature 116→(upper bridging portion of yoke Yk)→armature 126→No. 2 core 129

The first, second and third magnetic circuits MC 1, MC 2 and MC 3 constitute respectively separate circuits.

The magnetizing force MF1 required to be produced by the No. 1 coil L1 for activating the relay RL1 (to change from the condition shown in FIG. 3 to that of FIG. 4) is less than the value (MF2) required to be produced by the No. 1 coil L1 for activating the relay RL2. Specifically, due to the mutual reinforcement of magnetic flux flows in the third magnetic circuit MC3 as described above, the magnetizing force acting on the armature 116 can be sufficient for activating the relay RL1 (contact switch CS1 becomes set on) even if the magnetizing force MF1 is less than MF2.

Hence, the level of electric power required for activating the relay RL1, and also the level of power required for then maintaining the relays RL1, RL2 in the activated state, can be reduced by comparison with prior art types of relay apparatus.

Second Embodiment

A second embodiment will be described referring to FIGS. 5~7. The second embodiment is a relay system 10 which incorporates the relay apparatus 11A of the first embodiment, and is installed on a motor vehicle.

Components of the second embodiment corresponding to those of the first embodiment are indicated by the same reference designations as for the first embodiment. In the following description it is assumed that accidental activation of the relay RL1 at the time of activating the relay RL2 is prevented (i.e., ensuring that the relay RL2 can be activated prior to activating the relay RL1) only by utilizing a magnetic flux restriction section in the yoke Yk, as shown in FIG. 2 and described above. However it would be equally possible to also (or alternatively) configure the relay system to produce an opposing-direction flow of magnetic flux $\phi a$ in the coil L2 as described referring to FIG. 3.

Figure 5:
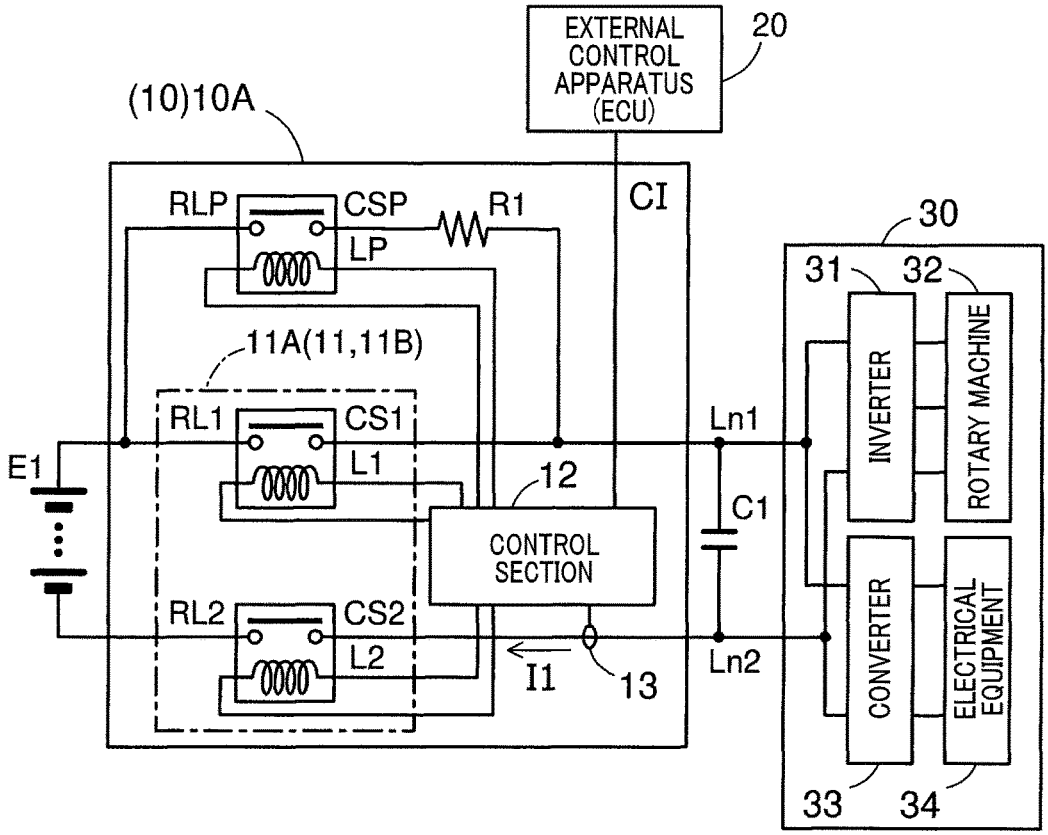
FIG. 5 is an overall block diagram of a first embodiment of a relay system incorporating the relay apparatus of FIG. 1.

As shown in FIG. 5, the relay apparatus 11A of the relay system 10A enables a battery E1 (in this case, a secondary type of battery such as a lithium-ion battery) to be connected/disconnected to/from an electrical load 30. The electric power is transferred via a pair of supply leads Ln1 and Ln2 connected between the relay apparatus 11A and the electrical load 30. A smoothing capacitor C1 is connected between the supply leads Ln1 and Ln2. for smoothing an output voltage from the electrical load 30 when power is supplied for charging the battery E1. The supplying of power from the battery E1 to the load 30 by the relay system 10A is controlled by control signals Cl transmitted from an external apparatus 20, which with this embodiment is an ECU (electronic control unit). More specifically the control signals Cl are transmitted to a control section 12 of the control system 10A, described hereinafter.

The electrical load 30 of this embodiment consists of an inverter 31 (operable for DC/AC and AC/DC electric power conversion)), a rotary machine 32, a converter (power voltage converter) 33, and electrical equipment 34. It would be possible for either or both of the inverter 31 and the converter 33 to be controlled by signals supplied from the external apparatus 20.

Designating the side of the relay apparatus 11A opposite to the battery E1 as the output side, the inverter 31 and the converter 33 are each connected in parallel with that output side (i.e., in parallel with the supply leads Ln1 and Ln2). The input side of the relay apparatus 11A is connected in parallel with the battery E1.

The rotary machine 32 of this embodiment is a motor-generator apparatus of the host vehicle, which produces motive power when supplied with electric power from the battery E1, or is driven to generate electric power. The inverter 31 converts the (DC) power from the battery E1 to AC power which is supplied to the rotary machine 32, and performs the inverse operation for supplying power from the rotary machine 32 to charge the battery E1. The converter 33 converts the electric power from the battery E1, to suitable form for being supplied to the electrical equipment 34 of the vehicle. The electrical equipment 34 can consist for example of a vehicle navigation system, lamps such as headlamps, interior lamps, etc., vehicle air conditioner apparatus, heater apparatus, etc., motors for operating windshield wipers, etc.

Only the condition in which power is supplied (discharged) from the battery E1 to the equipment constituting the electrical load 30 is considered in the following description.

As shown in FIG. 5, the relay system 10A includes the relay apparatus 11A, a precharging relay RLP, a current limiting resistor R1 and a control section 12. The precharging relay RLP includes a precharging coil LP and a contact switch CSP, and can be installed at an arbitrary location within the housing Hs shown in FIG. 1 or external to the housing Hs. The positive-polarity terminal of the battery E1 is connectable via the contact switch CS1 and the supply lead Ln1 to a positive-polarity terminal (for the purposes of this description, an input terminal) of the electrical load 30. The negative-polarity terminal of the battery E1 is connectable via the contact switch CS2 and the supply lead Ln2 to a negative-polarity terminal of the electrical load 30. The coils L1 and L2 of the relays RL1 and RL2 are controlled respectively separately by the control section 12, for being driven to the magnetic excitation/non-excitation states. A current sensor 13 detects the level of current flowing in the supply lead Ln2.

Figure 6:
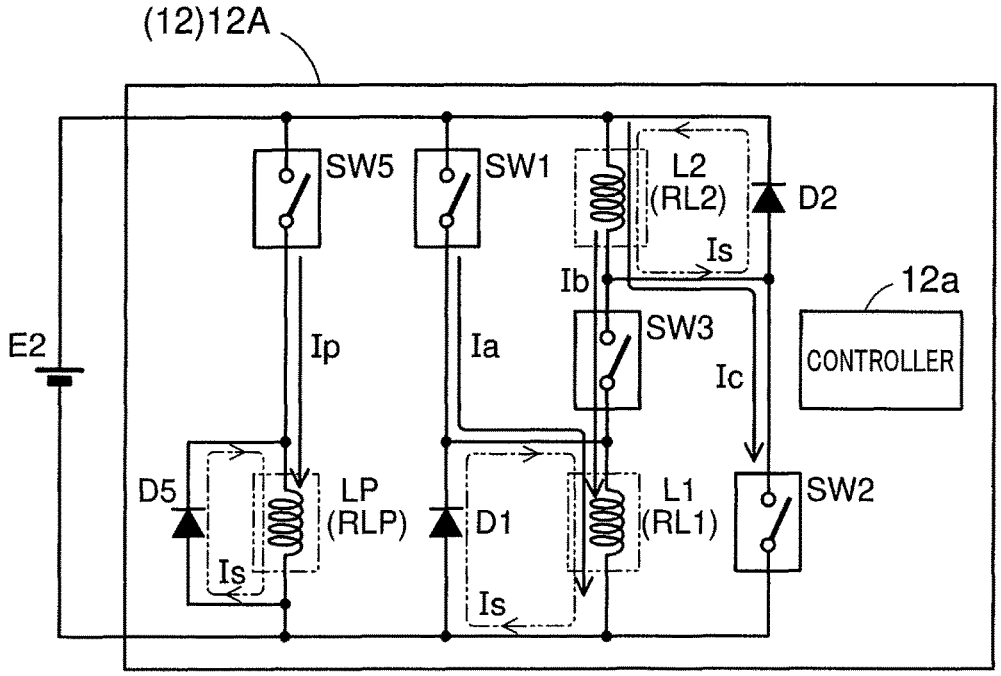
FIG. 6 is a circuit diagram of a first example of a control section of the relay system of FIG. 5.

FIG. 6 shows a first example the circuit configuration of the control section 12, designated as control section 12A. The control section 12A operates from power supplied by a battery E2, used as a DC power source, which is separate from the battery E1. The control section 12A incorporates switching devices SW1, SW3, SW5 (where "switching device" signifies any type of on/off switch that can be operated by a control signal, including semiconductor devices such as transistors), diodes D1, D2 and D5, and a coil spring 120. The switching devices SW1, SW2, SW3 are controlled by respective control signals applied from a controller 12*a*, for successively activating the relays RL2 and RL1 as described above, for activating the relay RLP, and for changeover of the relays RL1 and RL2 between a parallel-connected condition and a series-connected condition across the battery E2. If the relay RLP is not utilized, the switching device SW5 and diode D5 are not required. Various devices, including thyristors etc., may be used as the diodes D1, D2 and D5.

With this embodiment, the battery E2 is a secondary type of storage battery such as a lead-acid battery, whose voltage and power output capabilities are lower than those of the battery E1.

The first switch SW1 and the diode D1 are connected in series, constituting a first series-connected section. The No. 2 coil L2, the third switch SW3 and the No. 2 coil L2 are connected in series to constitute a second series-connected section. The second switch SW2 and the diode D2 are connected in series, constituting a third series-connected section, and the fourth switch SW5 and the diode D5 are connected in series, constituting a fourth series-connected section. The first, second, third and fourth series-connected sections are connected in parallel with one another, and in parallel with the battery E2. The diodes D1, D2, D5 are connected respectively across the coils L1, L2, LP, with a forward conduction direction that is opposite to the direction of current flow through the corresponding one of the coils L1, L2, LP (when such flows are enabled, as described in the following).

The junction of the first switch SW1 and the diode D1 is connected to the junction of the third switch SW3 and the No. 1 coil L1. The junction of the No. 2 coil L2 and the third switch SW3 is connected to the junction of the diode D2 and the second switch SW2.

Figure 7:
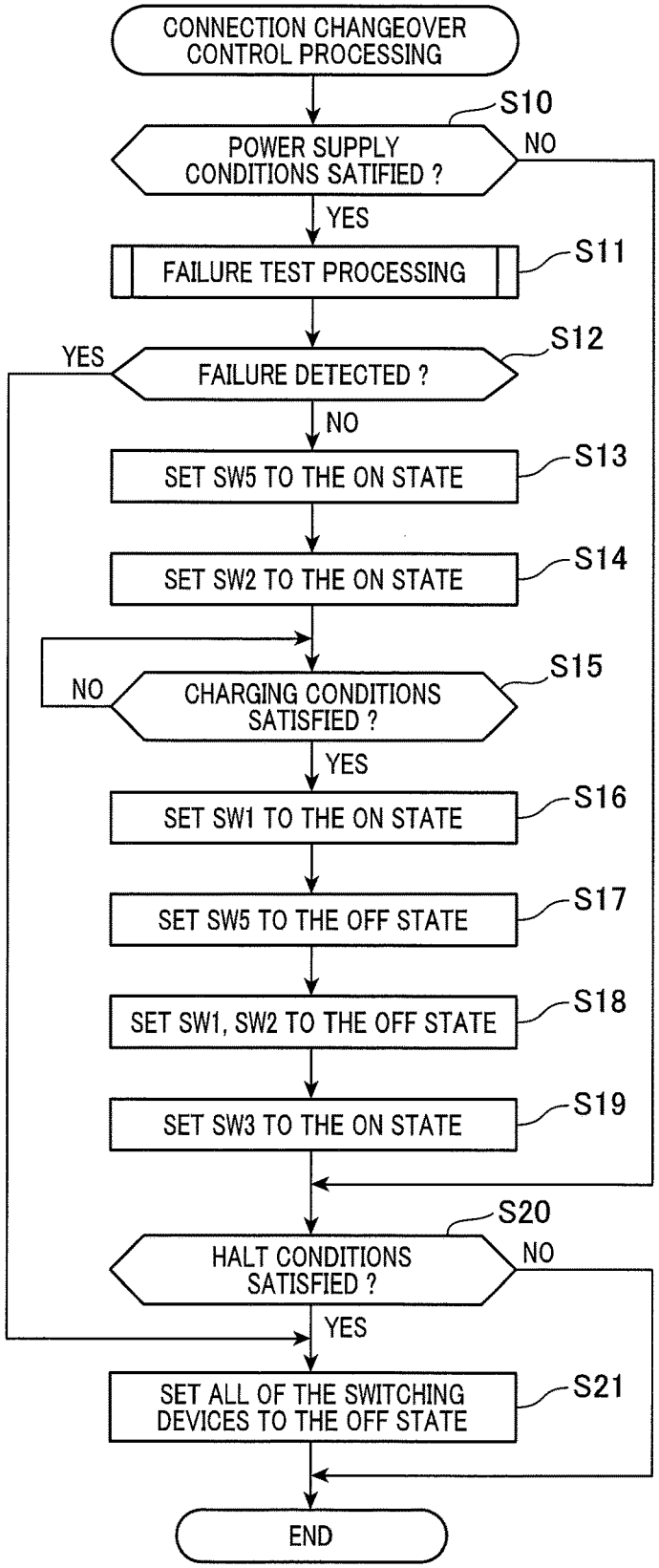
FIG. 7 is a flow diagram of changeover control processing that is executed by the control section of FIG. 6.

FIG. 7 is a flow diagram of connection changeover control processing that is executed by the controller 12*a*. Steps S11 and S12, for detecting abnormal operation, are optional. Firstly (step S10), a decision is made as to whether predetermined start conditions are satisfied. These conditions can be arbitrarily determined. With this embodiment, the start conditions are that the vehicle carrying the relay system 10A is running (so that the rotary machine 32 is being driven), and that the electrical equipment 34 of the vehicle is in operation. If these start conditions are not satisfied (NO decision), this execution of the processing is terminated. If a YES decision, failure detection processing (step S11) is executed. If an abnormal condition is detected (YES in step S12), step S21 is then executed. If a NO decision in step S12, step S13 is executed. The failure detection processing of step S11 judges whether a failure condition of one or both of the relays RL1 and RL2 has occurred. Specifically, a condition is detected whereby the fixed/movable contacts of one or both of the contact switches CS1 and CS2 have become attached together (welded).

Figure 19:
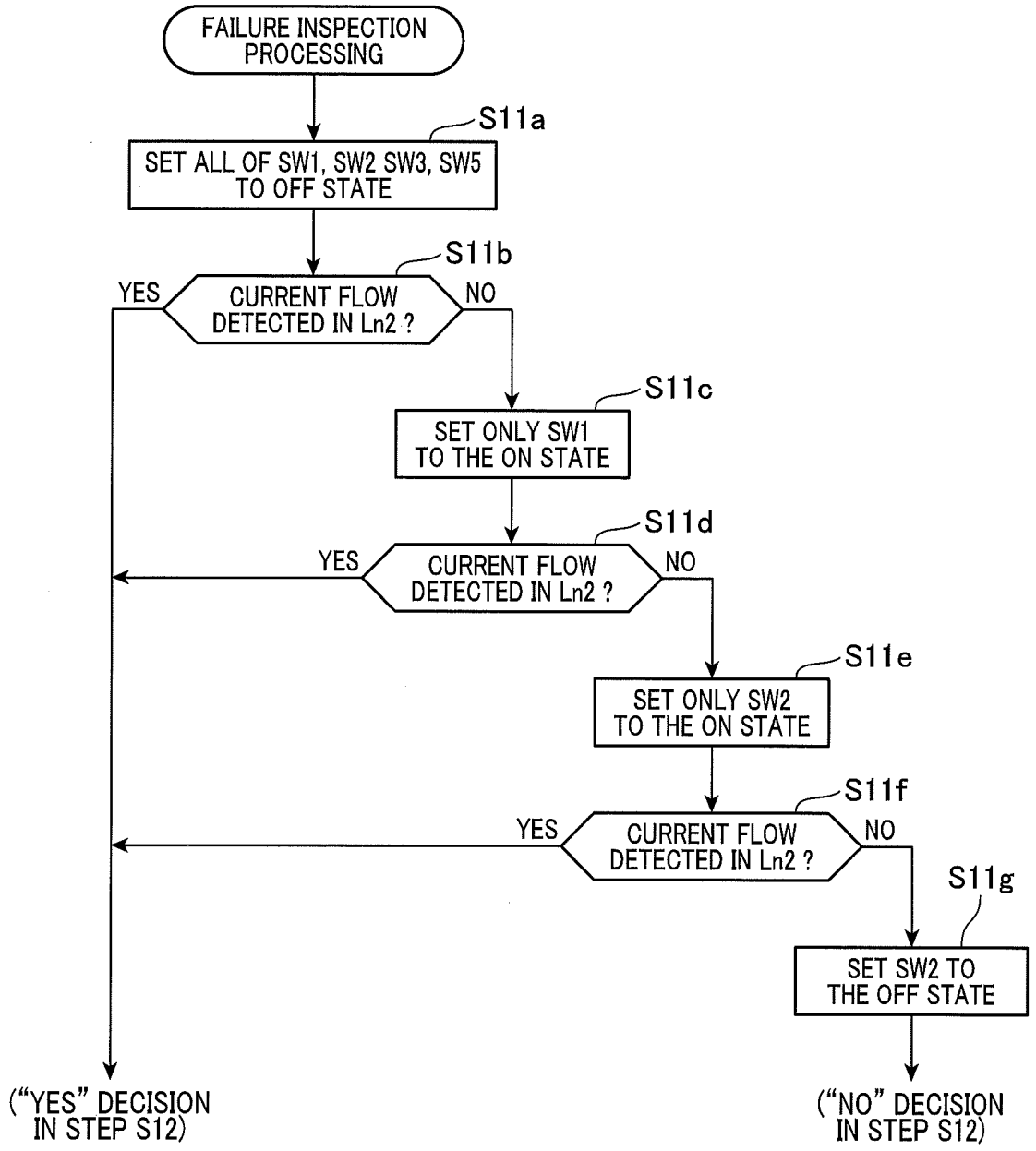
FIG. 19 is a flow diagram of failure inspection processing that is executed by the control section of FIG. 6 or FIG. 8.

The contents of step S11 are illustrated in the flow diagram of FIG. 19. Firstly all the switching devices SW1, SW2, SW3 and SW5 are set in the off state (step S11*a*). Both of the contact switches CS1 and CS2 should now be in the off state. In that condition, as a first judgement step (step S11*b*), if a current (I1>0) is now detected in the supply lead Ln2 then this is judged to indicate failure (e.g., contact welding) of both of the contact switches CS1 and CS2.

If no current is detected in the first judgement step, only the switching device SW1 is then set in the on state (step S11*c*). Only the relay RL1 should now be activated, so that only the supply lead Ln1 should be in a conducting state. As a second judgement step (step S11*d*), if a current (I1>0) is now detected in the supply lead Ln2, this indicates failure of the contact switch CS2.

If no current is detected in the second judgement step, only the switching device SW2 is then set in the on state (step S11*e*), so that only the relay RL2 should be now activated. In that condition, only the supply lead Ln2 should be in a conducting state. As a third judgement step (step S110, if a current (I1>0) is now detected in the supply lead Ln2, this indicates failure of the contact switch CS1. If no current is detected (NO decision in step S11*f*) then (step S11*g*) the switching device SW2 is set to the off state (so that all of the switching devices SW1, SW2, SW3 and SW5 are now initialized to the off state), and a NO decision is reached for step S12 of FIG. 7.

If a current (I1>0) is detected in any of the first, second or third judgement steps above, indicating failure of one or both of the relays RL1 and RL2, a YES decision is reached in step S12 of FIG. 7. In that case, all of the switching device SW1, SW2, SW3, SW5 are set to the off state (step S21) and this execution of the processing is ended. Repair or replacement of the relays RL1 and RL2 is then performed.

If both of the relays RL1 and RL2 are judged to be normal (NO in step S12), the switching device SW5 is set in the on state (step S13), to pass current through the precharging coil LP and so set the contact switch CSP in the on state.

After the switching device SW5 has been set to the on state (or concurrent with this) the switching device SW2 is set to the on state (step S14) thereby producing magnetic excitation in the No. 2 coil L2 by a current Ic. A condition is thereby established for the relay apparatus 11A whereby a magnetizing force MF2 (acting on the armature 126) is greater than a magnetizing force MF1 (acting on the armature 116), such that the relay RL2 now becomes activated while the relay RL1 remains inactivated.

Since both of the contact switches CS2 and CSP are now in the on state, a charging current flows from the battery E1 through the current limiting resistor R1 into the smoothing capacitor C1, thereby commencing precharging of the capacitor C1.

This is continued until a predetermined charge storage condition has become satisfied (YES decision in step S15). The charge storage condition can be for example that the relay RLP has remained activated for a predetermined time interval, or that the smoothing capacitor C1 has become charged to a predetermined voltage, or that the current I1 flowing through the supply lead Ln2 has fallen to a predetermined value. When the charge storage condition has become satisfied, the switching device SW1 is set to the on state (step S16), producing magnetic excitation in the No. 1 coil L1 of the relay RL1.

The condition shown in FIG. 4 is thereby established, with a current Ia flowing through the No. 1 coil L1 as shown in FIG. 6, in a direction for producing an opposite direction of magnetic flux flow through the No. 1 core 119 from that produced by the No. 2 coil L2 through the No. 2 core 129. Mutually reinforced magnetic flux flow thereby occurs in the magnetic circuit MC3, as described above. The currents Ia and Ib can have the same value (e.g., 500 mA), or respectively different values.

After the switching device SW1 has been set on, the switching device SW5 is set to the off state (step S17), thereby halting the flow of current Ip through the coil LP, and so deactivating the relay RLP and thus ending the charging of the smoothing capacitor C1.

The switching devices SW1 and SW2 are then concurrently set to the off state (step S18), to halt the condition of parallel connection between the coils L1 and L2. Currents (Is) then flow momentarily via the diodes D1 and D2 as indicated by the broken-line circuits, and become dissipated. The switching devices SW1 and SW2 can be switched off simultaneously, without timing restrictions, so that system design is facilitated.

After the switching devices SW1 and SW2 have been switched off, the third switching device SW3 is set in the on state (step S19) so that a current flows Ib through the coils L1 and L2, which have become connected in series as shown in FIG. 6. Both of the relays RL1 and RL2 thereby remain activated, so that power continues to be supplied to the electrical load 30 from the battery E1.

A decision is then made (step S20) as to whether a predetermined condition for halting the supplying of power to the electrical load 30 is satisfied. The requisite condition can be for example that the host vehicle has become halted (including a temporary halt) so that the operation of the rotary machine 32 has become halted, or that the operation of the electrical equipment 34 has ended due to the vehicle having become halted, etc.

If the halt condition is satisfied (YES decision in S20), all of the switching devices of the control section 12 are set to the off state (step S21), and this execution connection changeover processing is terminated. If the halt condition is not satisfied (NO decision in step S20), the connection changeover processing is terminated without any other action being performed.

With the relay system described above, the yoke of the relay apparatus 11A is formed with a magnetic flux restriction section such as that shown in FIG. 2, for ensuring that the relay RL2 will be activated prior to the relay RL1. However it may be preferable to reliably ensure this by also (or alternatively) controlling the current passed through the coil L1 of the relay RL1 as described referring to FIG. 3 above, i.e., for producing a magnetic flux ϕa in the coil L1 which opposes a magnetic flux ϕb produced by the coil L2 of the relay RL2. It will be apparent that this can readily be implemented by modifying the circuit of the controller 12*a* to sequentially:

(a) when relay RL2 is to be activated, connect the coil L1 across the battery E2 with a first connection polarity (to pass a current in a first direction through the coil L1 of the relay RL1, i.e., a direction whereby the magnetic flux ϕa of the coil L1 opposes the magnetic flux ϕb produced by the coil L2), (b) when relay RL1 is thereafter to be activated, connect the coil L1 across the battery E2 with a second connection polarity (to pass a current in a second direction, opposite to the first direction, through the coil L1 of the relay RL1, i.e., a direction whereby magnetic flux of the coil L1 reinforces magnetic flux of the coil L2 in the magnetic circuit MC3 as shown in FIG. 4), and (c) thereafter connect the coils L1, L2 in series across the battery E2, with the direction of current flow through the coils left unchanged.

It will be apparent that the circuit of the controller 12*a* shown in FIG. 6 can readily be modified to implement the above sequence of operations.

Third Embodiment

A third embodiment will be described referring to FIGS. 8 and 9, in which items corresponding to those of the second embodiment are indicated by identical reference numerals to those in FIGS. 5, 6.

Figure 8:
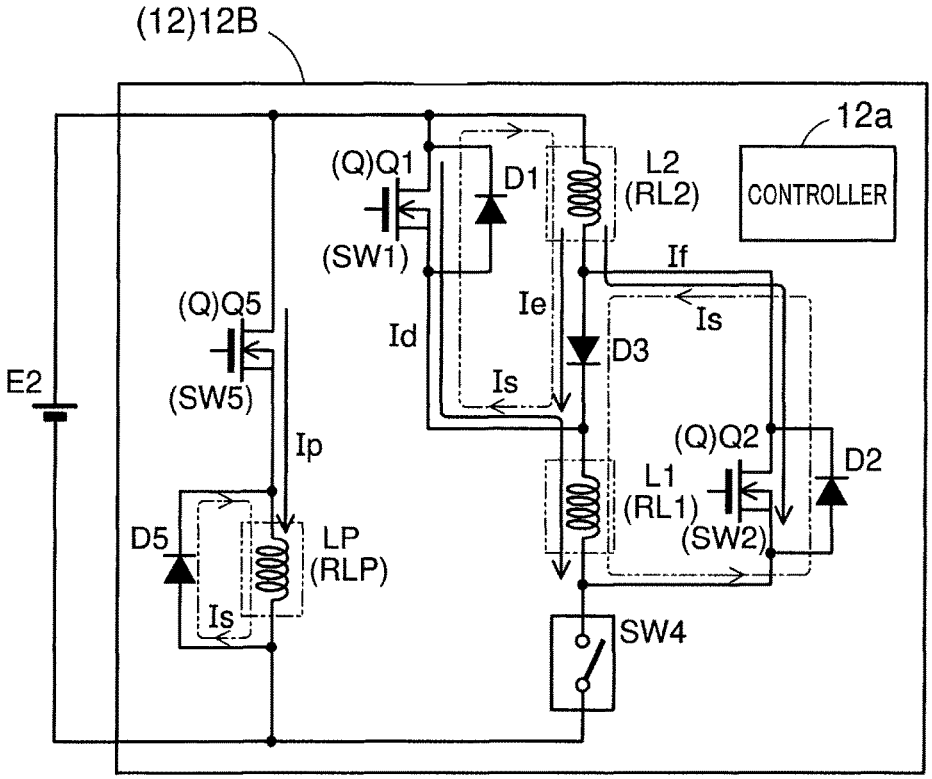
FIG. 8 is a circuit diagram of a second example of the control section of the relay system of FIG. 5.

The control section 12B shown in FIG. 8 is a configuration for the control section 12 of FIG. 5 which is an alternative to the control section 12A of FIG. 6. The control section 12B includes transistors Q1, Q2, Q5 which function as respective switching devices SW1, SW2, SW5, a switching device SW4, diodes D1, D2, D3, and D5, and a movable member 121.

The transistor Q5 (and processing steps S30 and S35 in FIG. 9) are required only if the precharging relay RLP is used.

The transistors Q1, Q2 and Q5 of this embodiment are respective MOS FETs, incorporating parasitic diodes which perform the functions of the diodes D1, D2, D3, and D5. However if other types of switching device are utilized as SW1, SW2 and SW5, which do not incorporate parasitic diodes, separate diode devices may be used as the diodes D1, D2, D3 and D5.

The No. 2 coil L2, the diode D3, the No. 1 coil L1 and the switching device SW4 are connected in series, with the combination being referred to in the following as the fifth series-connected section. The transistor Q1 is connected between the positive terminal of the battery E2 and the junction of the diode D3 and the No. 1 coil L1. The transistor Q2 is connected between the junction of the No. 2 coil L2 and the diode D3 and the junction of the No. 1 coil L1 and the switching device SW4.

The transistor Q5 and the coil LP are connected in series (constituting a sixth series-connected section), with the diode D5 and the coil LP connected in parallel. The fifth and the sixth series-connected sections are connected in parallel with the battery E2.

Figure 9:
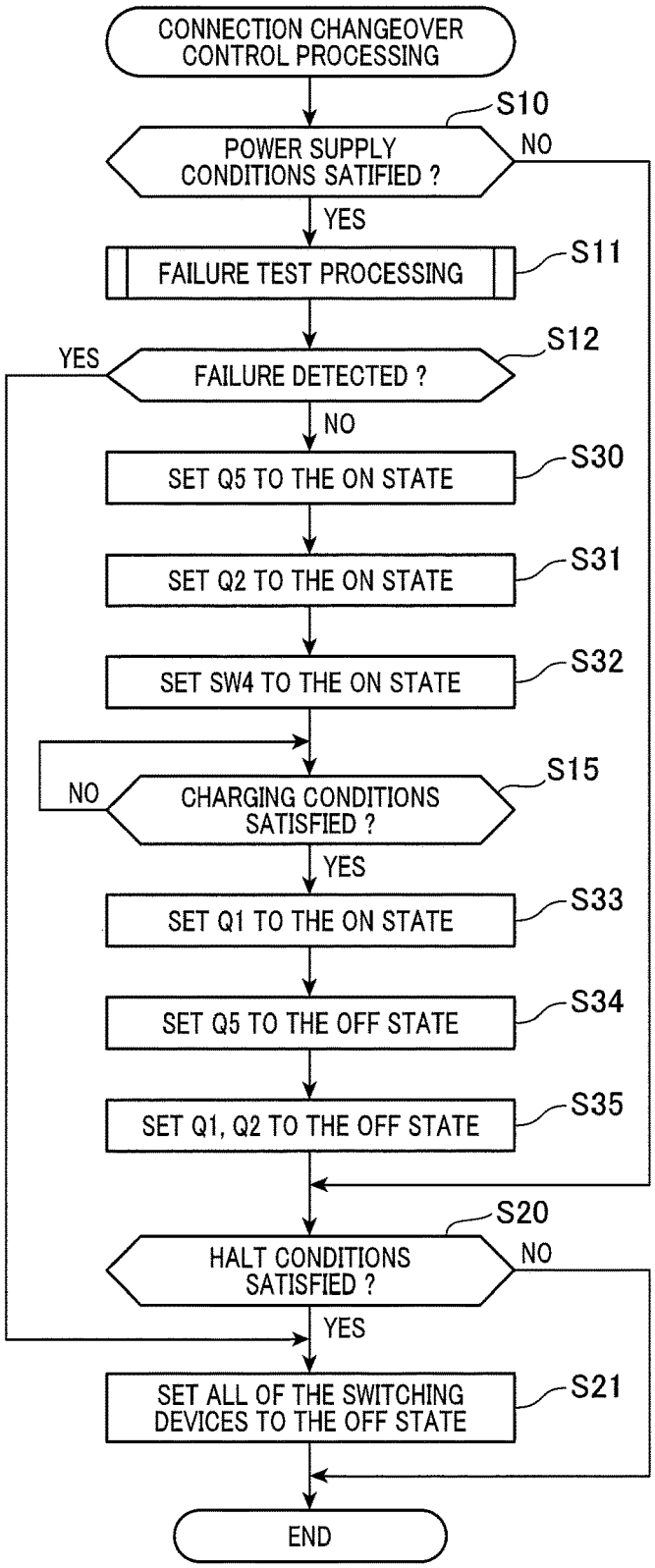
FIG. 9 is a flow diagram of changeover control processing that is executed by the control section of FIG. 8.

The failure diagnostic processing of step S11 in FIG. 9 (for the relays RL1 and RL2) is executed as described for step S11 of FIG. 7, but with the switching device SW4 being held in the on state, and with the functions of the switching devices SW1 and SW2 being performed by the transistors Q1 and Q2.

If it is judged that the relays RL1 and RL2 are functioning normally (NO decision in step S12), then the transistor Q5 is set in the on state (step S30) so that the current Ip flows, producing magnetic excitation of coil LP. The transistor Q2 is then set in the on state (step S31). With both of the transistors Q1 and Q2 in the on state, precharging of the capacitor C1 commences. The precharging is continued so long as the predetermined charging condition is not satisfied (NO decision in step S15).

Following step S31, the switching device SW4 is set to the on state (step S32). At that time, as shown in FIG. 8, a current If flows through the No. 2 coil L2 and the transistor Q2, so that the relay RL2 thereby becomes activated before the relay RL1, as described for the second embodiment.

When the predetermined charging condition is satisfied (YES decision in step S15), the transistor Q1 is set in the on state (step S33). At that time, the voltage applied across the terminals of the diode D3 is lower than the forward voltage of that diode, so that the currents Ie and If flow in parallel. As a result, the No. 1 coil L1 and the No. 2 coil L2 become connected in parallel. The condition of the relay apparatus 11A shown in FIG. 4 is thereby established. The currents Ie and If can have the same value, e.g., 500 mA, or respectively different values. At that time, as shown in FIG. 8, a current Id flows through the transistor Q1 and the No. 1 coil L1, so that both of the relays RL1 and RL2 have now become activated. Electric power is thereby supplied to the electrical load 30 from the battery E1.

After the transistor Q1 has been set in the on state (step S33) the transistor Q5 is set in the off state (step S34) to set the precharging relay RLP in the off state and end the precharging of the smoothing capacitor C1.

The transistors Q1 and Q2 are then both set to the off state concurrently (step S35) to change the No. 1 coil L1 and the No. 2 coil L2 from a parallel to a series connection condition. At this time, a current Ie flows through the fifth series-connected section (the No. 2 coil L2, the diode D3, the No. 1 coil L1 and the switching device SW4). The transistors Q1 and Q2 can be switched off simultaneously, without timing restrictions, so that system design is facilitated.

When the transistors Q1 and Q2 are switched off, currents Is then flow momentarily via the diodes D1, D2 and D5 as indicated by the broken-line circuits in FIG. 8, and become dissipated. In this condition, with magnetic excitation of both the No. 1 coil L1 and the No. 2 coil L2 by the flow of current Ie, both of the relays RL1 and RL2 remain activated, so that power continues to be supplied to the electrical load 30 from the battery E1.

Following step S35, a decision is made as to whether an operation halt condition is satisfied (step S20) If the condition is satisfied (YES decision), the switching device SW4 and all of the transistors Q1, Q2, Q3 are set to the off state (step S21). This execution of the connection changeover control processing is then ended. If the halt condition is not satisfied (NO decision in step S20), execution of the connection changeover processing is terminated without further action.

Fourth Embodiment

A fourth embodiment will be described referring to FIGS. 10 and 11, in which items corresponding to items of the first to third embodiments above are indicated by identical reference numerals to those of the above embodiments.

Figure 10:
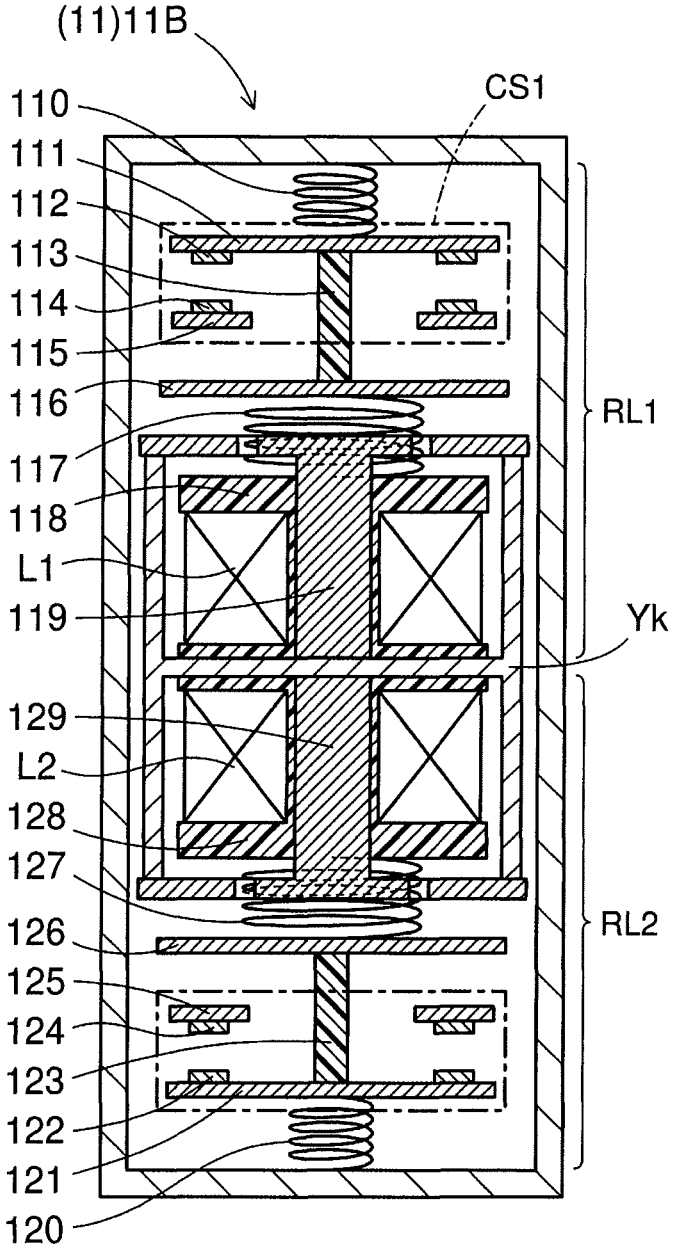
FIG. 10 is a conceptual cross-sectional view of a second embodiment of a relay apparatus.

FIG. 10 is a cross-sectional view of a relay apparatus 11B, which is a second example of a relay apparatus 11 according to the present invention. The relay apparatus 11B includes first and second relays RL1 and RL2, which operate respective contact switches CS1 and CS2, as for the relay apparatus 11A described above referring to FIG. 1. In the case of the relay apparatus 11A, the relays RL1 and RL2 are disposed side-by-side, adjacent to one another, with the arrangement of component parts of each relay along a central axial direction (a vertical direction as seen in FIG. 11) being identical between the relays RL1 and RL2. In the case of the relay apparatus 11B, the relays RL1 and RL2 are disposed adjacent to one another, oriented along the central axial direction, with the arrangement of corresponding component parts of each relay along the central axial direction being respectively opposite. In addition, as shown in FIG. 10, the yoke Yk of the relay apparatus 11B is configured differently from that of the relay apparatus 11A.

Figure 11:
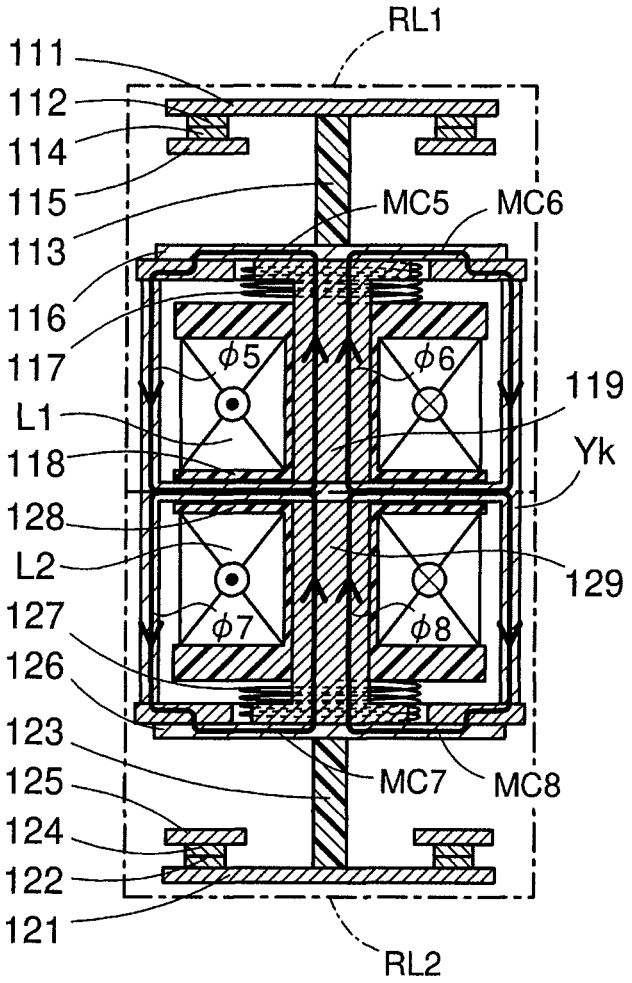
FIG. 11 is a conceptual partial cross-sectional view corresponding to FIG. 9, illustrating a condition in which both of respective relays of the relay apparatus are activated.

FIG. 11 shows the condition in which both of the relays RL1 and RL2 are in the on state. This corresponds to the condition shown in FIG. 4 for the relay apparatus 11A. In this condition, the magnetic excitation of the No. 1 core 119 occurs due to a current flowing through the No. 1 coil L1 in the indicated direction. A No. 1 magnetic flux ϕ5 and No. 2 magnetic flux ϕ6 are thereby produced, which each flow along a path:

No. 1 core 119→armature 116→yoke Yk (i.e., a part of the yoke Yk which surrounds the No. 1 coil L1)→No. 1 core 119

Magnetic circuit MC5 and MC6 are constituted by the paths through which the No. 1 magnetic flux ϕ5 and No. 2 magnetic flux ϕ6 respectively flow. The No. 1 magnetic flux ϕ5 and the No. 2 magnetic flux differ from one another in flowing through respectively different parts of the yoke Yk (i.e., a left-side portion and a right-side portion of the yoke Yk respectively, as viewed in FIG. 11). If current is passed through the No. 1 coil L1 in the opposite direction to that shown in FIG. 11, then the direction of flow of the No. 1 magnetic flux ϕ5 and No. 2 magnetic flux ϕ6 will be correspondingly reversed.

Magnetic excitation of the No. 2 core 129 is produced by current which flows in the No. 2 coil L2 in the direction indicated by the circled symbols in FIG. 11. No. 2 magnetic fluxes ϕ7 and ϕ8 are thereby generated, each of which flows in a path:

No. 2 core 129 armature 126→yoke Yk (i.e., a part of the yoke Yk which surrounds the No. 2 coil L2)→No. 2 core 129

Magnetic circuits MC7 and MC8 are thereby constituted, as the respective flow paths of the No. 2 magnetic fluxes ϕ7 and ϕ8. The No. 2 magnetic fluxes ϕ7 and ϕ8 differ from one another in that they flow through respectively parts of the yoke Yk (i.e., a left-side portion and a right-side portion, as viewed in FIG. 11).

If current is passed through the No. 2 coil L2 in the opposite direction to that shown in FIG. 11, the direction of flow of the No. 2 magnetic fluxes ϕ7 and ϕ8 will be correspondingly reversed.

As shown in FIG. 11, the No. 1 magnetic fluxes ϕ5 and ϕ6 which are passed by the No. 1 core 119, and the No. 2 magnetic fluxes ϕ7 and ϕ8 which are passed by the No. 2 core 129, flow in the same direction (i.e., an upward direction as viewed in FIG. 11). Since magnetic fluxes which flow in the same direction become mutually reinforced, the relays RL1 and RL2 will remain in the on state when the coils L1 and L2 have become connected in series. However in that condition, since the voltage across each of the coils L1 and L2 becomes half of the value applied during the parallel-connection condition, and the current which flows through each coil is correspondingly reduced, the power consumption required for maintaining both of the relays RL1 and RL2 in the on state is thereby reduced.

With this embodiment as shown in FIGS. 10 and 11, the relays RL1 and RL2 are oriented in respectively opposite directions (i.e., along a common central axis of the cores 119 and 129)). An advantage of this is as follows. When the relay apparatus is in the condition shown in FIG. 10, with both of the relays RL1 and RL2 inactivated so that no power is being supplied from the battery E1 to the electrical load 30, it is possible that an external force might be applied to one of the relays such as to cause the contact switch of that relay to be accidentally set in the on state. However with this embodiment, there is no danger that power will thereby be accidentally supplied to the electrical load 30 in such a case, since the contact switch of the other relay will remain in the off state.

With this embodiment, control of the relays RL1 and RL2 (and of the precharging relay RLP, if used) is performed as described for the second or third embodiment (see FIGS. 5~9), i.e., with the relay apparatus 11A being replaced by the relay apparatus 11B. Hence, the same performance can be expected as for the second and third embodiments.

Fifth Embodiment

A fifth embodiment will be described referring to FIGS. 12 and 13, in which items corresponding to items of the first to fourth embodiments above are indicated by identical reference numerals to those of the above embodiments. Only the features which are different from those of the first to fourth embodiments will be described in detail.

Figure 12:
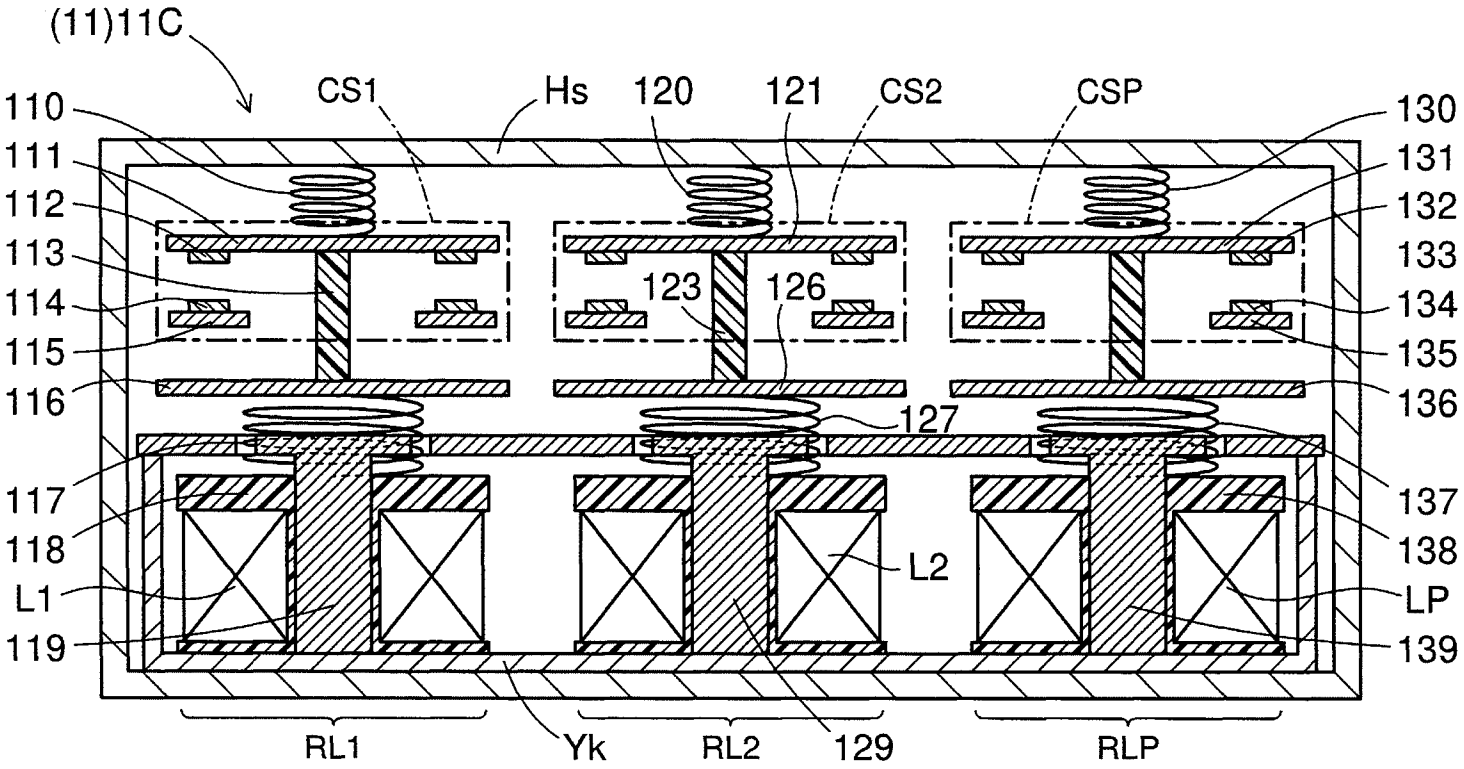
FIG. 12 is a conceptual cross-sectional view of a third embodiment of a relay apparatus.
Figure 13:
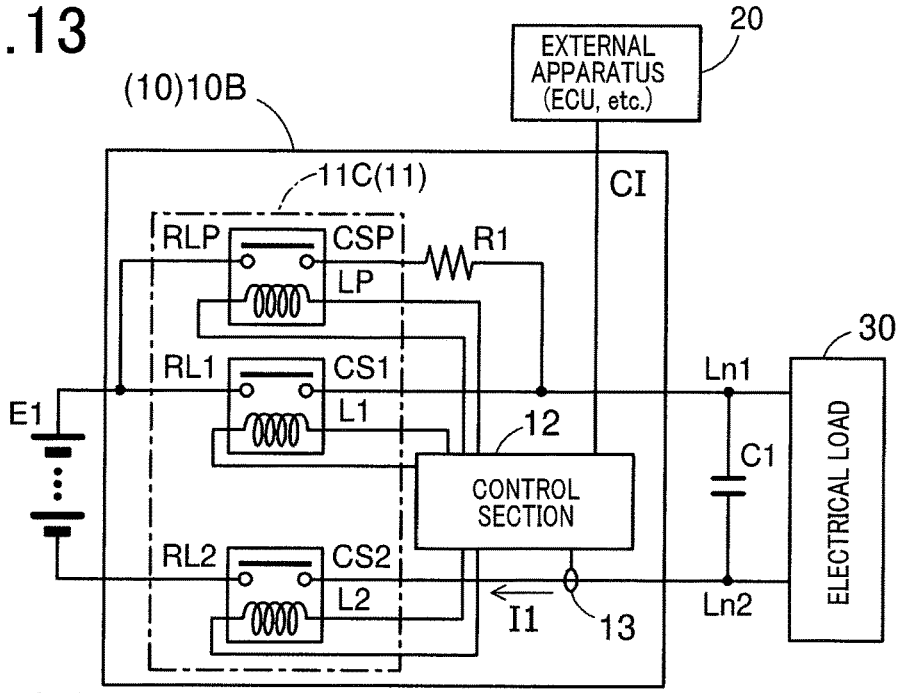
FIG. 13 is an overall block diagram of an embodiment of a relay system incorporating the relay apparatus of FIG. 12.

FIG. 12 is a cross-sectional view of a relay apparatus 11C of this embodiment, which includes first and second relays RL1 and RL2 and a precharging relay RLP which are each contained within a housing Hs. The configuration of the relay apparatus 11C differs from that of the relay apparatus 11A described above only in that a precharging relay RLP is incorporated within the housing Hs.

The precharging relay RLP includes a coil spring 130, a movable member 131, an insulator 133, a fixed member 135, an armature 136, a coil spring 137, a coil bobbin 138 a No. 3 core 139, and a precharging coil LP. A contact switch CSP indicated by the chain-line outline (also indicated in FIG. 13) is formed of a movable member 131, a movable contact 132, a fixed contact 134 and a fixed member 135. The precharging relay RLP has the same configuration as each of the relays RL1 or RL2, i.e., the coil springs 130 and 137 correspond to the coil springs 110 and 117 respectively, the movable member 131 corresponds to the movable member 111, the insulator 133 corresponds to the insulator 123, the fixed member 135 corresponds to the fixed member 115, the armature 136 corresponds to the armature 116, the coil bobbin 138 corresponds to the coil bobbin 118, the No. 3 core 139 corresponds to the No. 1 core 119, and the coil LP corresponds to the No. 1 coil L1.

The functions of the relay system 10B are identical to those of the relay system 10A described above, with respect to supplying electric power to the electrical load 30. However the relay system 10B differs from the relay system 10A by utilizing the relay apparatus 11C shown in FIG. 12.

With the relay system 10B, control of the relays RL1 and RL2 and of the precharging relay RLP is as described for the third and fourth embodiments (see FIGS. 5~9). That is, the relay apparatus 11C is controlled, in place of the relay apparatus 11A of the third and fourth embodiments. Hence, the same effects can be obtained as for the third and fourth embodiments.

Other Embodiments

The present invention is not limited to the embodiments described above. Various alternative embodiments, or modifications of the described embodiments, may be envisaged, as with the following examples.

Figure 14:
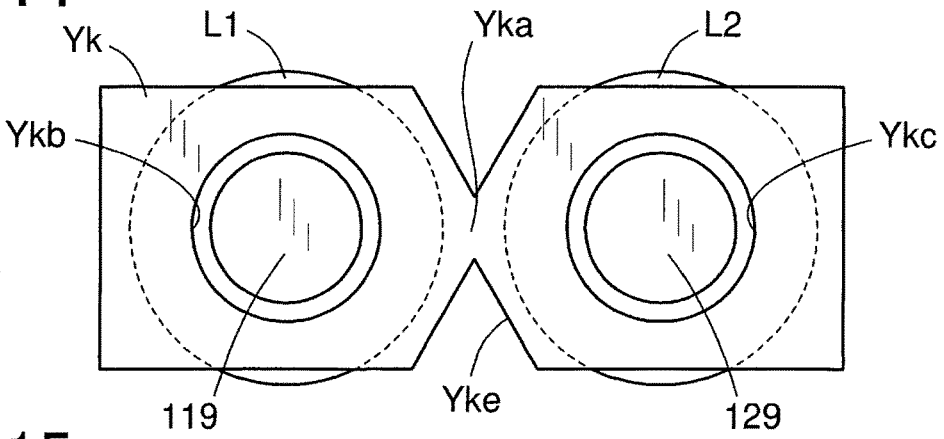
FIG. 14 is a plan view corresponding to FIG. 2, illustrating a second example of a magnetic flux restriction section formed in the yoke of the relay apparatus of FIG. 1.
Figure 15:
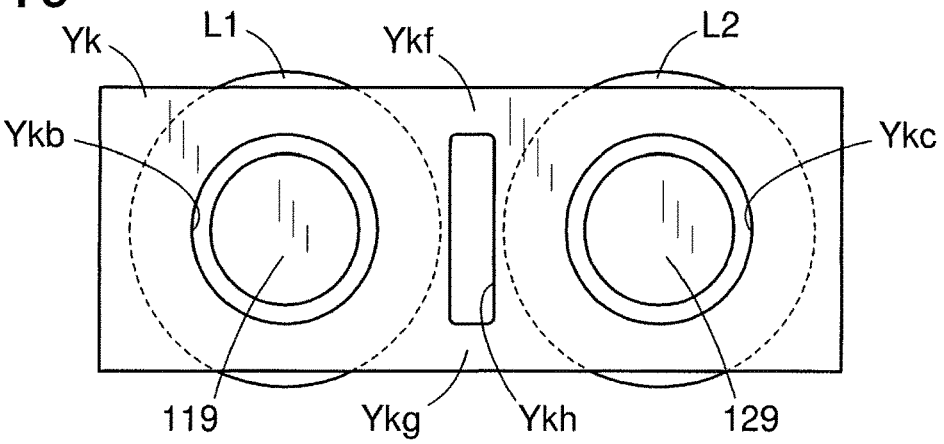
FIG. 15 is a plan view corresponding to FIG. 2, illustrating a third example of a magnetic flux restriction section formed in the yoke of the relay apparatus of FIG. 1.
Figure 16:
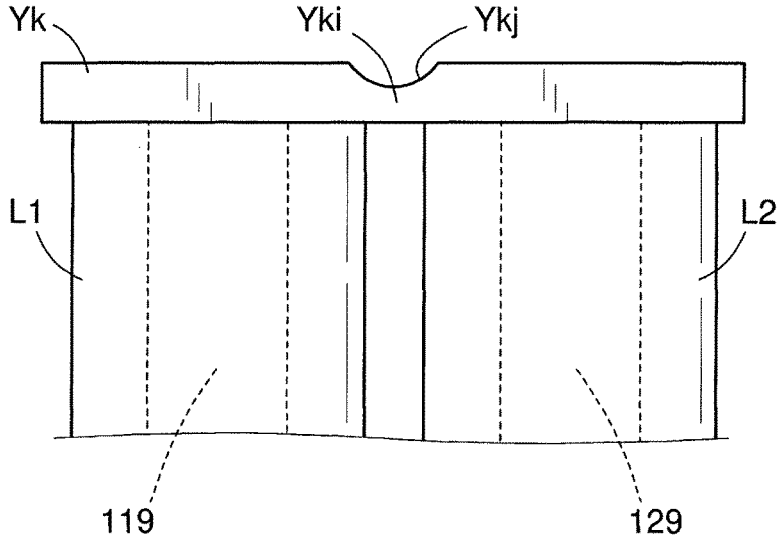
FIG. 16 is a partial side view illustrating a fourth example of a magnetic flux restriction section formed in the yoke of the relay apparatus of FIG. 1.

With the first to fifth embodiments, the magnetic flux restriction section Yka is formed by cut-out portions Ykd having a rectangular shape with rounded corners, as shown in FIG. 2. However it would be equally possible to use various other arrangements for restricting the flow of magnetic flux by forming a magnetic flux restriction section in the yoke Yk. For example it would be possible to form the magnetic flux restriction section Yka by using cut-out portions Yke having a triangular shape, as shown in FIG. 14. Alternatively as shown in FIG. 15, it would be possible to form a pair of magnetic flux restriction sections Ykf and Ykg by cutting a rectangular through-hole Ykh in the yoke Yk. As a further alternative as shown in FIG. 16, it would be possible to form a magnetic flux restriction section Yki by forming a part of one face (or of two opposing faces) of the yoke Yk with a concave shape Ykj. Furthermore it would be possible to use a combination of two or more of the magnetic flux restriction sections Yka, Ykf, Ykg, Yki. Whichever arrangement is utilized, the flow of magnetic flux in the third magnetic circuit MC3 is restricted such as to prevent unwanted reciprocating motion of the movable member 111, 121, or 131. FIGS. 14 and 15 are respective plan views, as for FIG. 2, while FIG. 16 is a side view.

Figure 17:
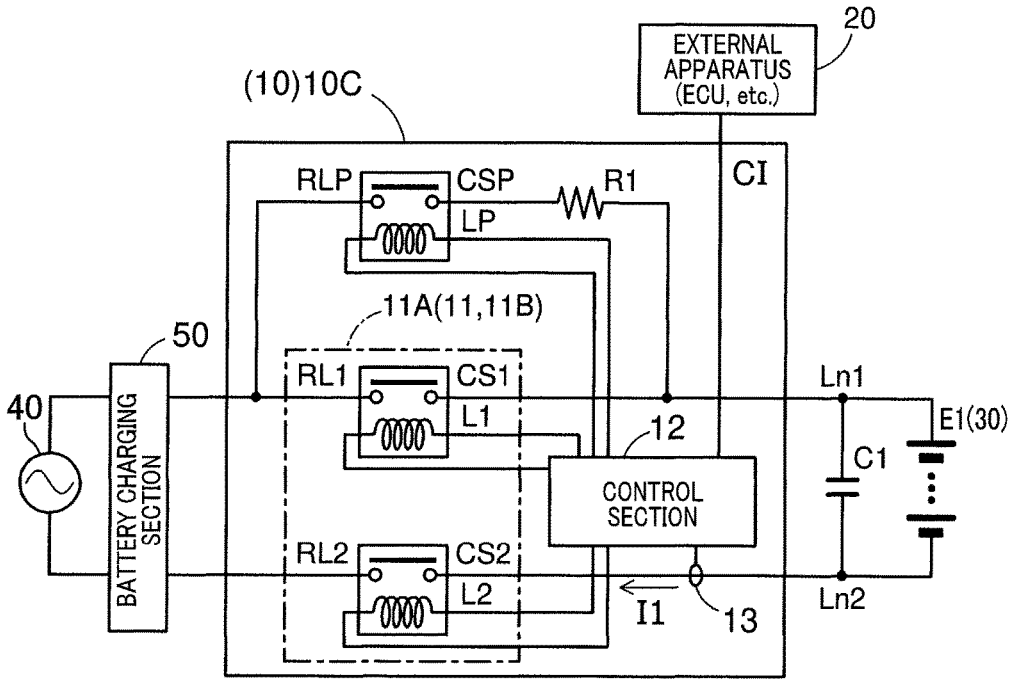
FIG. 17 is an overall block diagram of a second embodiment of a relay system incorporating the relay apparatus of FIG. 1.
Figure 18:
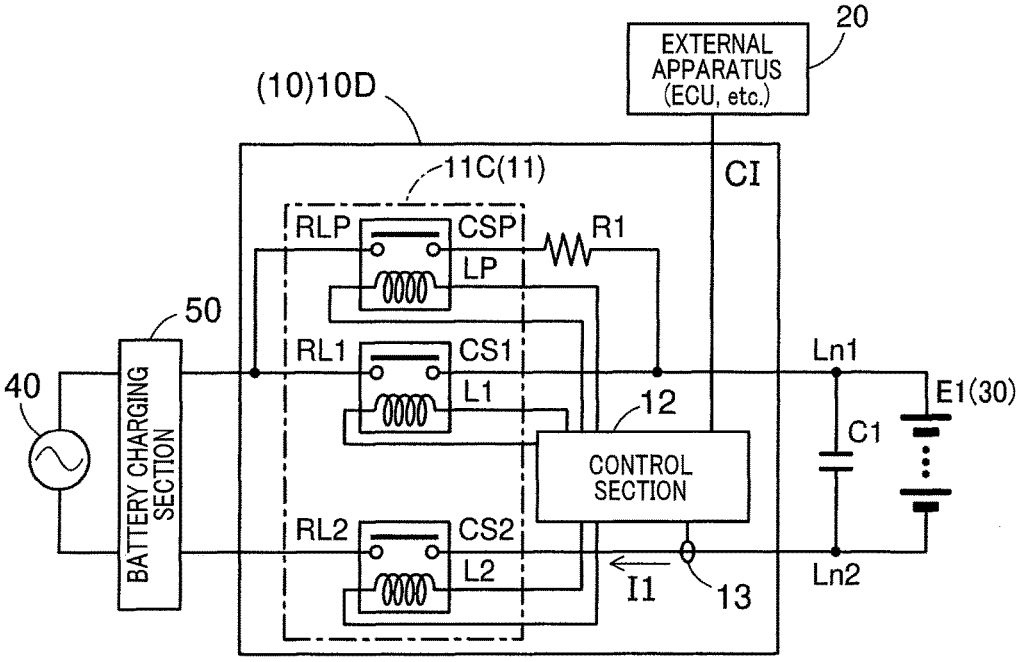
FIG. 18 is an overall block diagram of a second embodiment of a relay system incorporating the relay apparatus of FIG. 12.

With the first to fifth embodiments above, a system configuration is described whereby electric power from the battery E1 can be supplied to the electrical load 30, i.e., by discharging the battery E1. However alternatively (or in addition), the system configuration may be as shown in FIG. 17 or FIG. 18, wherein electric power from a commercial power source 40 is supplied to charge the battery E1, i.e., with the battery E1 constituting the electrical load 30 in this case, and with a charging section 50 (to convert electric power from the commercial power source 40, for charging the battery E1) being connected between the commercial power source 40 and the relay system 10. The system configuration in FIG. 17 corresponds to that of FIG. 5, while that of FIG. 18 corresponds to that of FIG. 13. It will be understood that in this case too, in which the battery E1 constitutes the electrical load 30, the same advantages (a reduced level of the power consumed in controlling the relays of the relay system 10, etc.) are obtained as for the preceding embodiments.

With the control section 12B of the third embodiment, MOS FET transistors which incorporate parasitic diodes are used as the transistors Q1 and Q2, performing a similar function to the switching devices SW1 and SW2 respectively of the control section 12A. However it would be equally possible to use MOS FETs which do not have parasitic diodes, or to use transistors other than MOS FETs, such as bipolar transistors (including power transistors), IGBTs, etc. Other than requiring the addition of separate diodes to function as the diodes D1 and D2, the same effects can be expected as those described above. This is also true for the transistor Q5.

Furthermore it would be equally possible to use a transistor as one of the switching devices SW1 and SW2 and to use a contact switch or a semiconductor relay, etc., as the other. Irrespective of the type of switching devices, the same effects can be expected as those described above for the third embodiment.

Furthermore with each of the first to fifth embodiments described above, each of the contact switches CS1 and CS2 is held in the off state when the corresponding one of the relays RL1, RL2 is not activated, and is set in the on state when the corresponding relay is activated. However it would be equally possible to configure the relay apparatus such that each of the contact switches CS1 and CS2 is held in the on state when the corresponding one of the relays RL1, RL2 is not activated, and is set in the off state when the corresponding relay is activated.

Furthermore with each of the first to fifth embodiments described above, the coils L1 and L2 are set in the series-connected condition after having been set in the parallel-connected condition (steps S15 to S18 in FIG. 7, steps S31 to S34 in FIG. 9). However alternatively, it would be possible to convert the coils L1 and L2 to the parallel-connected condition after having been set in the series-connected condition. For example, a system could be envisaged in which the status of the battery E1 is monitored (i.e., monitoring of the values of voltage and current being supplied by the battery E1) and in which threshold values of current and voltage required to be applied to the coils L1 and L2 for maintaining the contact switches CS1 and CS2 in the on state are stored in a non-volatile memory device. With such a system, when the coils L1 and L2 are connected in series and the current flowing in either (or both) of these coils is detected as falling below the threshold value, control would be applied for changeover of the coils L1 and L2 to become connected in parallel, thereby increasing the level of current flow through each of the coils L1, L2 and so increasing the magnetizing force produced by each coil. Such control could ensure that the on state of the contact switches CS1 and CS2 (the third condition of the relay apparatus, shown in FIG. 4) is securely maintained. Since this only involves only a change of the connection configuration, the same effects can be expected as those described above for the first to fifth embodiments The first to fourth embodiments have been described for the case of the relay apparatus 11A having two relays, RL1 and RL2 (see FIGS. 1, 3, 4, 5, 10, 11). The relay apparatus 11B of the fifth embodiment has three relays RL1, RL2 and RLP (see FIG. 12). However it would alternatively be possible to form the relay apparatus 11 with four or more relays, by appropriately altering the configuration of the relay system 10 to operate each of these relays. Since this involves only a change in the number of relays, the same effects can be expected as those described above for the first to fifth embodiments.

The above embodiments have been described for the case of using an electromagnet type of relay, in which magnetic flux produced by the coil of a relay causes attraction of the corresponding armature, to actuate the corresponding contact switch. (see FIGS. 1, 3, 4, 10, 11). However it would alternatively be possible to apply the invention to the use of solenoid relays, i.e., in which magnetic flux produced by the coil of a relay causes attraction of a corresponding plunger, to actuate a corresponding contact switch. If solenoid relays are utilized, the effects of the flows of magnetic flux will be similar to those described for the above embodiments, so that similar advantages can be obtained to those described for the first to fifth embodiments.

In the appended claims, "movable magnetic member" is used as a general term to signify an armature of a relay in the case of an electromagnet type of relay, and to signify a plunger of a relay, in the case of a solenoid type of relay.

Effects Obtained

The following effects are obtained by the first to fifth embodiments described above.

(1) With each of the above embodiments 11A~11C, the relay apparatus 11 comprises a plurality of coils (L1, L2, LP) which include at least a No. 1 (electromagnetic) coil L1 and a No. 2 coil L2, a No. 1 core 119 and a No. 2 core 129 positioned in respective central cavities in the No. 1 and No. 2 coils L1 and L2, and a yoke Yk. In the case of the relay apparatus 11A shown in FIGS. 1~4, having two relays RL1 and RL2, when a current is passed through the No. 1 coil L1, a No. 1 magnetic circuit (MC1, MC5, MC6) passes a flow of a No. 1 magnetic flux (ϕ1, ϕ5, ϕ6) through the No. 1 core 119 and the yoke Yk. When a current is passed through the No. 2 coil L2, a No. 2 magnetic circuit (MC2, MC7, MC8), which is separate from the No. 1 magnetic circuit (MC1, MC5, MC6), passes a flow of a No. 2 magnetic flux (ϕ2, ϕ7, ϕ8) through the No. 2 core 129 and the yoke Yk. When currents are passed concurrently through both the No. 1 coil L1 and the No. 2 coil L2, a third magnetic circuit (MC3) passes a flow of a third magnetic flux (ϕ3) through the No. 1 core 119, the No. 2 core 129 and the yoke Yk.

(2) With a relay apparatus having such a magnetic circuit configuration, when the respective directions of current flow through the No. 1 coil L1 and the No. 2 coil L2 are made such that the magnetic fluxes ϕ1, ϕ2 produced by the coils L1 and L2 (flowing in the No. 1 core 119 and No. 2 core 129) are mutually opposite in direction, respective parts of the magnetic fluxes produced by the coils L1 and L2 which flow through the third magnetic circuit (MC3) become mutually reinforced, as illustrated in FIG. 4. As a result, the levels of current flow required in the No. 1 coil L1 and the No. 2 coil L2 for maintaining both of the contact switches CS1, CS2 in the on state (after the relays RL1, RL2 have become successively activated) can be substantially reduced, by comparison with prior art types of relay apparatus, in which such magnetic flux reinforcement does not occur. The power consumption of the relay apparatus 11 (in particular, when all the relays of the apparatus must be left activated for long periods of time) can thereby be reduced.

(3) When it is required to reliably activate one of two relays of a relay apparatus 11 prior to the other, e.g., the relay RL2 of the relay apparatus 11A, this can be achieved by making the respective directions of current flow through the No. 1 coil L1 and the No. 2 coil L2 such that the magnetic fluxes ϕ1, ϕ2 produced by the coils L1 and L2 flow in same direction through the No. 1 core 119 and No. 2 core 129 respectively. As a result, the respective parts of the magnetic fluxes ϕ1, ϕ2 produced by the coils L1 and L2 which flow through the third magnetic circuit (MC3) become mutually opposed and so cancel one another, as illustrated in FIG. 3. Undesired magnetic attraction (e.g., of the armature 113 of the relay RL1) can thereby be prevented, and accidental (premature) activation of relay RL2 can thus be avoided. That is, it can be assured that the magnetic flux produced by the coil corresponding to a specific contact switch (e.g., CS2), which is required to be set in the on state before other contact switches, will not accidentally change any other contact switch (e.g., CS1) from the off to the on state.

(4) A relay system 10 (10A~10D) includes first switching devices SW1, SW2 for separately producing magnetic excitation of a plurality of coils comprising at least a first coil (L1) and a second coil (L2) of relays RL1, RL2 respectively, for actuating a first contact switch CS1 and a second contact switch CS2 by magnetic attraction, and a second switching device SW3 connected between the first coil and second coil. Changeover of the first coil and second coil between being connected in parallel and being connected in series is executed by on/off actuation of the first switching devices SW1, SW2 and second switching device(s) SW3 (see FIGS. 5, 6, 8). With such a configuration, sufficient degrees of magnetic force for activating the relays RL1, RL2 are ensured by first connecting the first and second coils L1, L2 in parallel with one another (step S16 in FIG. 7) and in parallel with a power supply voltage. That actuated condition (attracted condition of respective armatures 116, 126 of the relays RL1 and RL2) is thereafter maintained when the first and second coils L1, L2 become connected in series (steps S18, S19 of FIG. 7), with the supply voltage now being applied across the series-connected coils L1, L2.

If for example the first and second coils have identical resistance values, the value of current required to be supplied in the series-connected condition of the coils L1, L2 for maintaining the relays RL1I and RL2 activated (i.e., both of the contact switches CS1 and CS2 in the on state) is ¼ of the value that is supplied in the parallel-connected condition of the coils L1, L2. Hence, in the series-connected condition of the coils L1, L2, the power consumption of the relay apparatus 11 can be reduced by 75%.

(5) In addition, the coils L1 and L2 are preferably configured such that, with the same value of supply voltage applied to each, a specific one of the coils (in the embodiments, No. 2 coil L2) produces a greater magnetizing force than the other coil (in the embodiments, No. 1 coil L1). Specifically, the coils L1 may be formed with a higher resistance value than the No. 2 coil L2.

The effect of this is as follows, referring to FIG. 3 and to FIGS. 6, 7 of the second embodiment for example. The magnetizing force produced by the No. 2 coil L2, when connected in parallel with the battery E2, is predetermined to be sufficient for actuating the contact switch CS2 (by attracting the armature 126). When step S14 of FIG. 7 is executed, part of the magnetic flux produced by No. 2 coil L2 flows in the magnetic circuit M3, around the No. 1 coil L1. This is insufficient to actuate the contact switch CS1. However thereafter when the parallel-connected condition of the coils L1, L2 is established (by step S16 of FIG. 7) respective magnetic fluxes from the coils L2 and L2 become mutually reinforced, flowing in the magnetic circuit MC3. As a result, the magnetizing force (MF1) which acts on the armature 116 can be sufficient for actuating the contact switch CS1, in spite of the fact that the current passed through the No. 1 coil at that time is (by itself) insufficient for activating the relay RL1. Hence, the overall power consumption of the relay apparatus 11 can be further reduced.

(6) A relay system configuration may be utilized (see FIGS. 5, 13, 17, 18) having a sensor 13 for detecting a value of current supplied to the electrical load 30 from the battery E1 via one of the contact switches CS1 and CS2, with the detection information being supplied to a control section 12 which controls the respective magnetic excitation conditions of the coils L1 and L2. By selectively producing magnetic excitation of the coils L1 and L2 while monitoring the value of detected current, the control section 12 can readily detect a failure condition of either or both of the contact switches CS1 and CS2 whereby the movable contact of a switch has become welded to the fixed contact of the switch.

(7) A relay system configuration may be utilized (see FIGS. 13, 17, 18) which incorporates a precharging relay RLP, and a current limiting resistor R1 which becomes connected in parallel with the relay apparatus 11 when the precharging relay RLP is activated, for supplying a precharging current to a smoothing capacitor C1 (connected between the supply leads Ln1, Ln2). With this configuration, when both of the relays RL1 and RL2 have become activated, power is reliably supplied to the electrical load 30 irrespective of the state of the precharging relay RLP. That is, the supplying of power will be unaffected even in the event of failure of the precharging relay RLP.

(8) A relay system configuration may be utilized (see FIG. 6) in which changeover of the coils L1 and L2 of the relays RL1 and RL2 between the parallel-connected and series-connected condition is performed by control signals applied to respective switching devices SW1, SW2, SW3. However a configuration may alternatively be utilized (see FIG. 8) in which the functions of the switching devices SW2, SW2 are performed by respective transistors Q1, Q2. With that configuration, the switching device SW3 is eliminated, since changeover of the coils L1 and L2 between the parallel-connected and series-connected condition is performed by control signals applied only to the transistors Q1, Q2.

What is claimed is:

1. A relay apparatus, comprising:

a first relay, the first relay comprising:

a first electromagnetic coil;

a first movable magnetic member;

a first electromagnetic coil; and a first contact switch, the first contact switch being set to a predetermined one of a conducting condition and a non-conducting condition by a magnetic flux produced by the first electromagnetic coil acting on the first movable magnetic member;

a second relay, the second relay comprising:

a second electromagnetic coil;

a second movable magnetic member; and a second contact switch, the second contact switch being set to a predetermined one of the conducting condition and non-conducting condition by a magnetic flux produced by the second electromagnetic coil acting on the second movable magnetic member;

a yoke, the yoke being configured to partially surround each of the first electromagnetic coil and the second electromagnetic coil;

a first magnetic circuit extending around the first electromagnetic coil and through a first core and the yoke, the relay apparatus being operable for producing a flow of a first magnetic flux via the first magnetic circuit by passing a current through the first electromagnetic coil;

a second magnetic circuit extending around the second electromagnetic coil and through a second core and the yoke, the relay apparatus being operable for producing a flow of a second magnetic flux via the second magnetic circuit by passing a current through the second electromagnetic coil; and a third magnetic circuit extending successively through the first core, the yoke, and the second core, the relay apparatus being operable for producing a flow of a third magnetic flux via a third magnetic circuit by passing respective currents concurrently through the first electromagnetic coil and the second electromagnetic coil, wherein the yoke comprises a magnetic flux restriction portion formed to restrict the flow of magnetic flux via the third magnetic circuit.

2. The relay apparatus of claim 1 wherein the relay apparatus is operable for being set in a condition whereby the first contact switch and the second contact switch are respectively in the conducting condition, by passing a first current and a second current respectively through the first electromagnetic coil and the second electromagnetic coil, and respective flow directions of the first current and the second current are predetermined for rendering respective directions of a flow of flux produced by the first electromagnetic coil through the third magnetic circuit and of a flow of flux produced by the second electromagnetic coil through the third magnetic circuit mutually identical.

3. The relay apparatus of claim 1 wherein the relay apparatus is operable for being set in a condition whereby the first contact switch is in the conducting condition and the second contact switch is in the non-conducting condition, by passing a first current and a second current respectively through the first electromagnetic coil and the second electromagnetic coil, and respective flow directions of the first current and the second current are predetermined for rendering respective directions of a flow of flux produced by the first electromagnetic coil through the third magnetic circuit and of a flow of flux produced by the second electromagnetic coil through the third magnetic circuit mutually opposite.

4. The relay apparatus of claim 1, wherein the magnetic flux restriction portion comprises at least one portion of the yoke, formed with a smaller cross-sectional area than remaining portions of the yoke.

5. A relay system comprising:

the relay apparatus of claim 1;

a first electric power source; and a relay control circuit comprising a plurality of switching devices respectively connected to the first electromagnetic coil and second electromagnetic coil and to the first electric power source, the relay control circuit being configured to control the switching devices for successively establishing:

a first connection condition, in which only the first electromagnetic coil is connected in parallel with the first electric power source, a second connection condition, in which both of the first electromagnetic coil and the second electromagnetic coil are connected in parallel with the first electric power source, and a third connection condition, in which the first electromagnetic coil and the second electromagnetic coil are connected in series and the series-connected first electromagnetic coil and second electromagnetic coil are connected in parallel with the first electric power source.

6. The relay system of claim 5, wherein the relay control circuit comprises a first switching device, connected to the first electromagnetic coil and operable for connecting/disconnecting the first electromagnetic coil to/from the first electric power source, a second switching device, connected to the second electromagnetic coil and operable for connecting/disconnecting the second coil to/from the first electric power source, and a third switching device, connected to each of the first electromagnetic coil and the second electromagnetic coil, and operable for connecting/disconnecting the first electromagnetic coil and the second electromagnetic coil to/from a condition of being connected in series to the first electric power source.

7. The relay system of claim 5, controllable for selectively enabling/interrupting supplying of electric power from a second electric power source to an electrical load via a first supply lead and a second supply lead, wherein the first contact switch is connected in series with the first supply lead and the second contact switch is connected in series with the second supply lead.

8. The relay system of claim 5, wherein the second electromagnetic coil is configured to produce a smaller value of magnetizing force than is produced by the first electromagnetic coil when both of the first electromagnetic coil and the second electromagnetic coil are connected in parallel with an electric power source.

9. The relay system of claim 5, comprising a current sensor for detecting a flow of current through a specific one of the first supply lead and the second supply lead, wherein the relay control circuit is operable for executing a failure test procedure for detecting a failure condition of at least one of the first contact switch and the second contact switch, and the detection of the failure condition is based upon detection results obtained from the current sensor.

10. The relay system of claim 9 wherein the relay control circuit is configured to execute the failure test procedure by steps of controlling the plurality of switching elements to set each of the first contact switch and the second contact switch to the non-conducting condition, and judging whether a current flow is detected by the current sensor, controlling the plurality of switching elements to set only a first one of the first contact switch and the second contact switch to the conducting condition, and judging whether a current flow is detected by the current sensor, and controlling the plurality of switching elements to set only a second one of the first contact switch and the second contact switch to the conducting condition, and judging whether a current flow is detected by the current sensor.

11. The relay system of claim 5 further comprising:

a smoothing capacitor connected between the first supply lead and the second supply lead;

a third relay having a third contact switch and a third coil;

a fourth switching device connected to the third coil; and a current limiting resistor connected to one of the supply leads via the third contact switch, in parallel with the relay apparatus, wherein the relay control circuit is configured to control the fourth switching device to actuate the third contact switch by connecting the third coil across the second external power source and thereby execute precharging of the smoothing capacitor, after or concurrent with establishing the first condition of the relay apparatus and prior to establishing the third condition of the relay apparatus.

12. The relay system of claim 6, wherein at least one of the plurality of switching devices comprises a semiconductor device operated as a switching element.

13. A relay system comprising:

a relay apparatus comprising:

a first relay, the first relay comprising:

a first electromagnetic coil;

a first movable magnetic member; and a first contact switch, the first contact switch being set to a predetermined one of a conducting condition and a non-conducting condition by a magnetic flux produced by the first electromagnetic coil acting on the first movable magnetic member;

a second relay, the second relay comprising:

a second electromagnetic coil;

a second movable magnetic member; and a second contact switch, the second contact switch being set to a predetermined one of the conducting condition and non-conducting condition by a magnetic flux produced by the second electromagnetic coil acting on the second movable magnetic member; and a yoke, the yoke partially surrounding each of the first electromagnetic coil and the second electromagnetic coil;

an electric power source; and a relay control circuit comprising a plurality of switching devices respectively connected to the first electromagnetic coil and second electromagnetic coil and to the electric power source, the relay control circuit being configured to control the switching devices for successively establishing:

a first connection condition, in which a current is passed from the electric power source through only the first electromagnetic coil to produce a flow of magnetic flux via a first magnetic circuit, the first magnetic circuit extending around the first electromagnetic coil and the yoke, a second connection condition, in which a current is also passed from the electric power source through the second electromagnetic coil to produce a flow of magnetic flux via a second magnetic circuit, the second magnetic circuit extending around the second electromagnetic coil and the yoke, and a third connection condition, in which the first electromagnetic coil and the second electromagnetic coil are connected in series to the electric power source, and a current is passed from the electric power source through the series-connected first electromagnetic coil and second electromagnetic coil to produce a flow of magnetic flux via a third magnetic circuit, the third magnetic circuit extending successively around a first core, the yoke, and a second core, wherein a direction of current flow through the second electromagnetic coil is unchanged between the second connection condition and the third connection condition, and is predetermined whereby respective flows of magnetic flux produced by the first electromagnetic coil and the second electromagnetic coil pass in an identical direction through the third magnetic circuit.

14. The relay system of claim 13, wherein the yoke comprises a magnetic flux restriction portion formed to restrict the magnitude of flow of magnetic flux in the third magnetic circuit.

15. The relay system of claim 13, wherein the magnetic flux restriction portion comprises at least one portion of the yoke, formed with a smaller cross-sectional area than remaining portions of the yoke.

16. The relay system of claim 13, wherein in the first connection condition, the switching devices are controlled to pass a current from the electric power source through the second electromagnetic coil, for producing a flow of magnetic flux through the second magnetic circuit, and a flow direction of the current passed through the second electromagnetic coil in the first connection condition is predetermined whereby respective flows of magnetic flux produced by the first electromagnetic coil and the second electromagnetic coil pass in opposing directions through the third magnetic circuit.

17. The relay system of claim 13, wherein the plurality of switching devices comprise a first switching device, connected to the first electromagnetic coil and operable for connecting/disconnecting the first electromagnetic coil to/from a condition of being connected in parallel with the first electric power source, a second switching device, connected to the second electromagnetic coil and operable for connecting/disconnecting the second electromagnetic coil to/from a condition of being connected in parallel with the first electric power source, and a third switching device, connected to each of the first electromagnetic coil and the second electromagnetic coil, and operable for connecting/disconnecting the first electromagnetic coil and the second electromagnetic coil to/from a condition of being connected in series to the first electric power source.

18. The relay system of claim 13, controllable for selectively enabling/interrupting supplying of electric power from a second electric power source to an electrical load via a first supply lead and a second supply lead, wherein the first contact switch is connected in series with the first supply lead and the second contact switch is connected in series with the second supply lead.

19. The relay system of claim 13, wherein the second electromagnetic coil is configured to produce a smaller value of magnetizing force than is produced by the first electromagnetic coil when both of the first electromagnetic coil and the second electromagnetic coil are connected in parallel with the electric power source.

* * * * *